US009635897B2

(12) United States Patent
Prust et al.

(10) Patent No.: US 9,635,897 B2
(45) Date of Patent: May 2, 2017

(54) CUSHION ITEMS WITH FLEXIBLE CONTOURING

(71) Applicant: BACKJOY ORTHOTICS, LLC., Boulder, CO (US)

(72) Inventors: Peter C. Prust, Zionsville, IN (US); Allen Siekman, Ben Lomond, CA (US)

(73) Assignee: BACKJOY ORTHOTICS, LLC, Boulder, CO (US)

( * ) Notice: Subject to any disclaimer, the term of this patent is extended or adjusted under 35 U.S.C. 154(b) by 86 days.

(21) Appl. No.: 14/201,506

(22) Filed: Mar. 7, 2014

(65) Prior Publication Data

US 2014/0182049 A1 Jul. 3, 2014

Related U.S. Application Data

(63) Continuation-in-part of application No. 13/755,959, filed on Jan. 31, 2013, now Pat. No. 9,125,493.
(Continued)

(51) Int. Cl.
*A47C 27/00* (2006.01)
*A42B 3/12* (2006.01)
(Continued)

(52) U.S. Cl.
CPC ..... *A42B 3/12* (2013.01); *A42B 3/10* (2013.01); *A43B 13/38* (2013.01); *A47C 7/021* (2013.01);
(Continued)

(58) Field of Classification Search
CPC ..... A47C 7/022; A47C 23/002; A47C 7/18; A61G 5/1043; B60N 2/7035; B32B 3/30
(Continued)

(56) References Cited

U.S. PATENT DOCUMENTS 1,296,359 A 3/1919 Brown
1,922,228 A 8/1933 Brown
(Continued)

FOREIGN PATENT DOCUMENTS

CN 1694638 A 11/2005
CN 201948487 U 8/2011
(Continued)

OTHER PUBLICATIONS

U.S. Appl. No. 13/755,959, filed Jan. 31, 2013, titled "Seat Cushion with Flexible Contouring".
(Continued)

*Primary Examiner* — Sarah McPartlin
(74) *Attorney, Agent, or Firm* — Brooks Acordia IP Law, P.C.; Michael Zarrabian

(57) ABSTRACT

A cushion for supporting a user relative to a support surface is provided. The cushion has material with sufficient flexibility to deform under a weight of the user and sufficient resilience to return to its original state when the weight is removed. A supporting face contacts the support surface and is characterized by a plurality of points. The supporting face is contoured such that, when the cushion is in an unloaded configuration, a first subset of the plurality of points contact the support surface and a second subset of the plurality of points do not contact the support surface. When a user then sits on the cushion so that it is in a loaded configuration, at least some of the points in the second subset are displaced under the user's weight and contact the support surface. The cushion thus both bends and compresses to distribute the weight of the user.

19 Claims, 26 Drawing Sheets

Related U.S. Application Data

(60) Provisional application No. 61/593,155, filed on Jan. 31, 2012, provisional application No. 61/775,356, filed on Mar. 8, 2013, provisional application No. 61/775,364, filed on Mar. 8, 2013, provisional application No. 61/775,369, filed on Mar. 8, 2013, provisional application No. 61/775,374, filed on Mar. 8, 2013, provisional application No. 61/775,382, filed on Mar. 8, 2013, provisional application No. 61/775,388, filed on Mar. 8, 2013.

(51) Int. Cl.

| | |
|---|---|
| ***A42B 3/10*** | (2006.01) |
| ***A43B 13/38*** | (2006.01) |
| ***A47C 7/02*** | (2006.01) |
| ***A47C 21/04*** | (2006.01) |
| ***A47C 27/14*** | (2006.01) |
| ***A47D 15/00*** | (2006.01) |

(52) U.S. Cl.
CPC ..... *A47C 7/022* (2013.01); *A47C 21/046* (2013.01); *A47C 27/146* (2013.01); *A47D 15/001* (2013.01)

(58) Field of Classification Search
USPC ..... 297/452.21, 452.26; 5/653
See application file for complete search history.

(56) References Cited

U.S. PATENT DOCUMENTS

| | | | |
|---|---|---|---|
| 1,982,516 | A | 11/1934 | Holmested |
| 2,082,151 | A | 6/1937 | De Poix |
| 2,434,641 | A | 1/1948 | Burns |
| 2,552,039 | A | 5/1951 | Flogaus |
| 3,148,390 | A | 9/1964 | Vakousky |
| 3,231,454 | A | 1/1966 | Williams |
| 3,468,311 | A | 9/1969 | Gallagher |
| 3,514,156 | A | 5/1970 | Fields |
| 3,553,748 | A | 1/1971 | Ross |
| 3,605,145 | A | 9/1971 | Graebe |
| 4,070,719 | A | 1/1978 | Morgan |
| 4,143,916 | A | 3/1979 | Trotman et al. |
| 4,194,255 | A | 3/1980 | Poppe |
| 4,205,880 | A | 6/1980 | Trotman et al. |
| D262,590 | S | 1/1982 | Trotman et al. |
| 4,435,015 | A | 3/1984 | Trotman et al. |
| 4,529,248 | A | 7/1985 | Trotman et al. |
| 4,605,582 | A | 8/1986 | Sias et al. |
| 4,673,452 | A | 6/1987 | Awdhan |
| 4,673,605 | A | 6/1987 | Sias et al. |
| 4,686,724 | A | 8/1987 | Bedford |
| 4,698,864 | A | 10/1987 | Graebe |
| D294,212 | S | 2/1988 | Sias et al. |
| 4,866,800 | A | 9/1989 | Bedford |
| 4,892,353 | A | 1/1990 | Goddard |
| 4,989,284 | A | 2/1991 | Gamm |
| 5,010,609 | A | 4/1991 | Farley |
| 5,015,037 | A | 5/1991 | Giblin et al. |
| D323,092 | S | 1/1992 | Fenner, Sr. |
| 5,079,790 | A | 1/1992 | Pouch |
| D329,566 | S | 9/1992 | Davidson, Jr. |
| 5,158,073 | A | 10/1992 | Bukowski |
| 5,160,785 | A | 11/1992 | Davidson, Jr. |
| 5,243,722 | A | 9/1993 | Gusakov |
| 5,286,089 | A | 2/1994 | Goldman |
| D345,072 | S | 3/1994 | Rose et al. |
| 5,294,181 | A | 3/1994 | Rose et al. |
| 5,325,552 | A | 7/1994 | Fong |
| D355,558 | S | 2/1995 | Graebe |
| 5,402,545 | A | 4/1995 | Jolley |
| 5,411,318 | A | 5/1995 | Law |
| 5,444,881 | A | 8/1995 | Landi et al. |
| 5,459,896 | A | 10/1995 | Raburn et al. |
| D372,157 | S | 7/1996 | Bonaddio et al. |
| D375,863 | S | 11/1996 | Bigolin |
| 5,607,749 | A | 3/1997 | Strumor |
| D378,968 | S | 4/1997 | Martin et al. |
| 5,628,079 | A | 5/1997 | Kizemchuk et al. |
| 5,645,314 | A | 7/1997 | Liou |
| 5,692,952 | A | 12/1997 | Chih-Hung |
| D389,692 | S | 1/1998 | Graebe et al. |
| D389,702 | S | 1/1998 | Graebe et al. |
| D391,110 | S | 2/1998 | Graebe |
| 5,749,111 | A | 5/1998 | Pearce |
| 6,009,578 | A | 1/2000 | Davis |
| 6,018,832 | A | 2/2000 | Graebe |
| 6,161,238 | A | 12/2000 | Graebe |
| 6,162,638 | A | 12/2000 | Papadopoulou et al. |
| D449,170 | S | 10/2001 | Kim |
| 6,701,556 | B2 | 3/2004 | Romano et al. |
| 6,726,285 | B2 | 4/2004 | Caruso et al. |
| D497,761 | S | 11/2004 | Martin |
| 6,818,676 | B2 | 11/2004 | Koffler et al. |
| 6,901,617 | B2 | 6/2005 | Sprouse, II et al. |
| 6,938,290 | B2 | 9/2005 | McKinney et al. |
| 7,083,236 | B1 | 8/2006 | Smith |
| 7,120,956 | B1 | 10/2006 | Liao |
| 7,695,069 | B2 | 4/2010 | Prust |
| 9,125,493 | B2 * | 9/2015 | Siekman ..... A47C 7/021 |
| 2002/0013407 | A1 | 1/2002 | Pearce |
| 2002/0185898 | A1 | 12/2002 | Smith |
| 2003/0037377 | A1 | 2/2003 | Kawamura et al. |
| 2004/0098806 | A1 | 5/2004 | Stender et al. |
| 2005/0022305 | A1 | 2/2005 | Bieganek et al. |
| 2005/0235423 | A1 | 10/2005 | Hetzel et al. |
| 2008/0016622 | A1 | 1/2008 | Prust |
| 2010/0295221 | A1 | 11/2010 | Kligerman et al. |
| 2012/0180199 | A1 | 7/2012 | Chilson et al. |
| 2013/0193738 | A1 | 8/2013 | Siekman et al. |

FOREIGN PATENT DOCUMENTS

| | | |
|---|---|---|
| GB | 2274054 | 7/1994 |
| JP | 2005-95472 | 4/2005 |
| JP | 2006095101 | 4/2006 |
| JP | 2009-406 | 1/2009 |
| JP | 2009-000406 | 1/2009 |
| WO | 98/04170 | 2/1998 |
| WO | 2006/037970 | 4/2006 |
| WO | 2008011488 | 1/2008 |
| WO | 2013116438 A2 | 8/2013 |
| WO | WO-2013116438 A2 | 8/2013 |
| WO | 2013116438 A3 | 9/2013 |
| WO | WO-2013116438 A3 | 9/2013 |

OTHER PUBLICATIONS

International Search Report and Written Opinion; PCT/US2013/024008; mailed Aug. 5, 2013.

U.S. Appl. No. 13/755,959, "Non-Final Office Action", Aug. 25, 2014, 12 pages.

Notice of Allowance for U.S. Appl. No. 13/755,959, mailed Apr. 29, 2015.

Chinese Office Action for Application No. 201380007636.2, mailed Mar. 9, 2016.

Canadian Office Action for Application No. 2,861,385, mailed Jun. 4, 2015.

Japanese Office Action for Application No. 2014-554983, mailed Jan. 21, 2015.

Posey® Foam Heel Guards—6127, 6145, 6145BT. Posey Company. Mar. 6, 2013. <URL: http://www.posey.com/files/M6011-Posey%C2%AE-Foam-Heel-Guards.pdf>(retrieved on Jun. 5, 2014).

International Search Report and Written Opinion for PCT/US2014/022132, mailed Jun. 23, 2014.

Notice of Allowance for U.S. Appl. No. 13/755,959, mailed Jan. 22, 2015.

Posey® Foam Heel Guards—6127, 6145, 6145BT. Posey Company. Mar. 6, 2013. <URL: http://www.posey.com/files/M6011-

(56) References Cited

OTHER PUBLICATIONS

Posey%C2%Ae-Foam-Heel-Guards.pdf> (retrieved on Jun. 5, 2014).

* cited by examiner

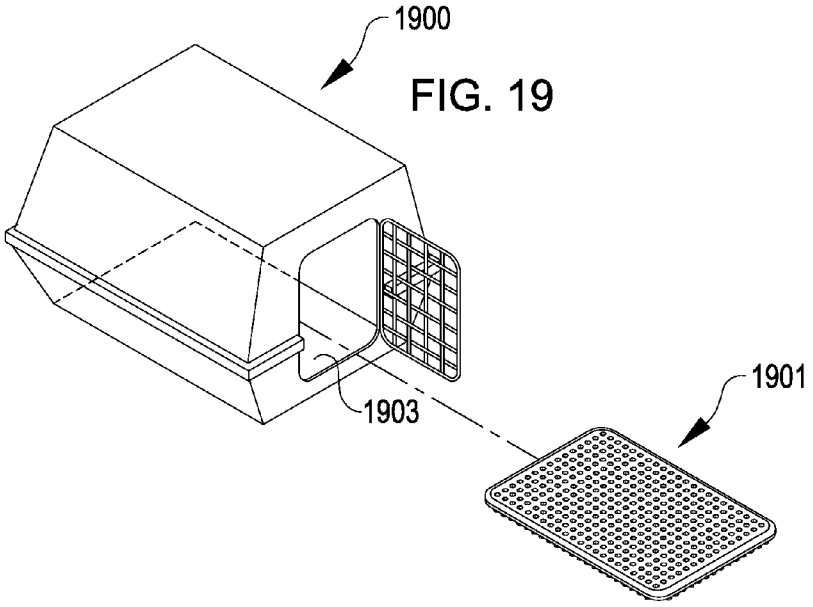
FIG. 19
FIG. 20
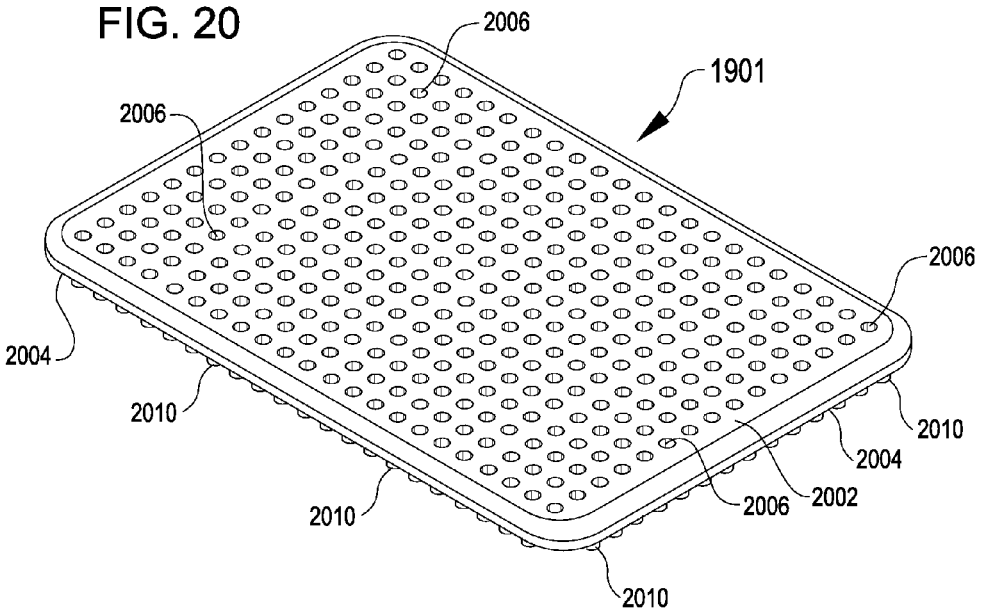

CUSHION ITEMS WITH FLEXIBLE CONTOURING

CROSS-REFERENCES TO RELATED APPLICATIONS

This application is a Continuation-in-Part of U.S. application Ser. No. 13/755,959, entitled "SEAT CUSHION WITH FLEXIBLE CONTOURING," filed Jan. 31, 2013, and published as U.S. Publication No. 2013/0193738 on Aug. 1, 2013, which claims the benefit of U.S. Provisional Application No. 61/593,155, entitled "SEAT CUSHION WITH FLEXIBLE CONTOURING," filed Jan. 31, 2012, the entire disclosures of which are hereby incorporated herein by reference.

This application also claims the benefit of U.S. Provisional Application No. 61/775,356, entitled "ORTHOTIC WITH FLEXIBLE CONTOURING," filed Mar. 8, 2013, U.S. Provisional Application No. 61/775,364, entitled "SLEEPING SURFACE CUSHION OVERLAY," filed Mar. 8, 2013, U.S. Provisional Application No. 61/775,369, entitled "PET CRATE LINER," filed Mar. 8, 2013, U.S. Provisional Application No. 61/775,374, entitled "BICYCLE SEAT CUSHION COVER," filed Mar. 8, 2013, U.S. Provisional Application No. 61/775,382, entitled "YOGA MAT," filed Mar. 8, 2013, U.S. Provisional Application No. 61/775,388, entitled "HELMET CUSHION," filed Mar. 8, 2013, the entire disclosures of which are hereby incorporated herein by reference.

BACKGROUND OF THE INVENTION

Many objects utilize cushions or cushioning to provide increased support and/or comfort. Often, a cushion may be a distinct item placed in between a support surface and an object to be supported. Alternatively, some items include one or more layers of built-in cushioning integral to the item. Commonly, cushioning includes one or more layers of material that acts as an intervening barrier between objects to reduce an amount of pressure that would otherwise be transferred between the objects. However, certain problems can arise with existing cushions. For example, existing cushions may undesireably act as an insulating layer preventing the escape of heat from a cushioned object. Some cushions may reduce pressure too much and fail to adequately support an object as a result. Accordingly, improvements over existing cushions are desirable.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Cushioned items with ventilation and desirable impact, shock, and/or pressure responsive characteristics are disclosed.

In one embodiment, a cushion for supporting at least a portion of a user's body relative to a support surface is provided. Before a user places his or her weight on the cushion by sitting on it, the cushion is in an unloaded configuration. Once the user places his or her weight on the cushion by sitting on it, the cushion is in a loaded configuration. The cushion has material with sufficient flexibility for the cushion to deform from this unloaded configuration toward the loaded configuration when the load of the user's weight is placed on the cushion. The cushion also has sufficient resilience to return from the loaded configuration toward the unloaded configuration when the user gets up and the weight of the user is removed from the cushion. The cushion can be separated into three main parts: a body, a sitting face on the top side of the body, and a supporting face on the underside of the body. The sitting face is the part of the cushion which will actually contact the supported portions of the user's body when the user is supported by the cushion. The supporting face contacts the support surface and can be characterized by a plurality of points. The supporting face can also be contoured such that, when the cushion is in the unloaded configuration, a first subset of the plurality of points contact the support surface and a second subset of the plurality of points do not contact the support surface. When a user then sits on the cushion so that it is in the loaded configuration, at least some of the points in the second subset are displaced under the user's weight and contact the support surface.

In many embodiments the supporting face of the cushion further comprises a plurality of pillars. Each pillar has a top end connected to the body of the cushion and a bottom end corresponding to one of the plurality of points. In the cushion's unloaded state, some pillars do not touch the support surface. These pillars correspond to the second subset of the plurality of points, and they are shorter than the pillars corresponding to the first subset of the plurality of points, which do touch the ground when the cushion is in its unloaded state.

In embodiments, the pillars corresponding to the second subset are shortest underneath an area of the cushion designed for receiving the ischial tuberosities of the user. In embodiments, the second subset pillars increase in height as pillar placement on the supporting face moves away from an area of the cushion designed for receiving the ischial tuberosities of the user.

In embodiments, as the weight of the user is placed on the cushion, the cushion body is sufficiently flexible so that the cushion bends while deforming toward the loaded configuration, and the material is sufficiently compressible so that it also compresses in distributing a weight of the user. In some embodiments, the cushion first bends to match the contour of the user's body while deforming toward the loaded configuration and then compresses to support and distribute the weight of the user.

In some embodiments, the cushion body, sitting face, and supporting face are made of one piece by injection molding. In some embodiments, the cushion contains material that is single density, closed-cell foam, such as ethylene-vinyl acetate (EVA) foam.

The cushion can also have a sitting face with a contour configured to match a generic anatomical shape of a seated user. The contour can include a recessed area configured to receive a pelvis and coccyx of the user, and/or elevated components to support and orient thighs and hips of the user.

In some embodiments, the supporting face has troughs between the pillars such that surface tension on the supporting face is decreased to lower a magnitude of a force needed for bending or compressing the cushion near the troughs. In some embodiments, the troughs are rounded. In some embodiments, the troughs are positioned in a row and column pattern. In some embodiments, the troughs are positioned only in locations of maximum surface tension. In some embodiments, the troughs extend over the entirety of the supporting face.

In some embodiments, the cushion has ports which provide openings extending through the seating face, the body, and the supporting face.

In some embodiments, a cushion is configured for a method for supporting at least a body part of a person. The method involves, in response to receiving a first portion of a weight of at least the body part of a person on the cushion, bending and changing shape of the cushion to conform to a contour of the body part. The method also involves, in response to receiving a second portion of weight of at least the body part of the person on the cushion, compressing the material in the cushion according to the distribution of the load, wherein the combination of the change of shape and compression of the cushion act to redistribute pressure against at least the body part supported by the cushion.

For a fuller understanding of the nature and advantages of the present invention, reference should be made to the ensuing detailed description and accompanying drawings.

BRIEF DESCRIPTION OF THE DRAWINGS

FIG. 19 is a perspective exploded assembly view of a pet crate liner and a pet crate in accordance with various embodiments.

FIG. 20 is a top perspective view of a pet crate liner in accordance with various embodiments.

DETAILED DESCRIPTION OF THE INVENTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to a variety of cushions or cushioned items, including, but not limited to, orthotic footwear inserts, sleeping surface overlays, pet crate liners, bicycle seat covers, yoga mats, and helmets. This disclosure additionally includes a description of a seat cushion (FIGS. 1 to 5), which is described and claimed in PCT Patent Application No. PCT/US2013/024008, entitled "SEAT CUSHION WITH FLEXIBLE CONTOURING," filed Jan. 31, 2013, which claims the benefit of U.S. Provisional Application No. 61/593,155, entitled "SEAT CUSHION WITH FLEXIBLE CONTOURING," filed Jan. 31, 2012, the entire disclosures of which are hereby incorporated herein by reference.

Relevant Anatomy (For Seat Cushion)

The human body was not designed for sitting. Humans are designed to ambulate on two legs with the makeup of the skeletal support within the body designed for walking. That being the case, humans do spend a lot of time sitting and a significant number are not able to stand or walk due to accident, disease, or age related limitations. People that sit for a large portion of time during the day may require specialized seating to provide increased comfort, controlled posture or protection from the development of decubitus ulcers (also known as bed sores or pressure sores).

Figure 1B:
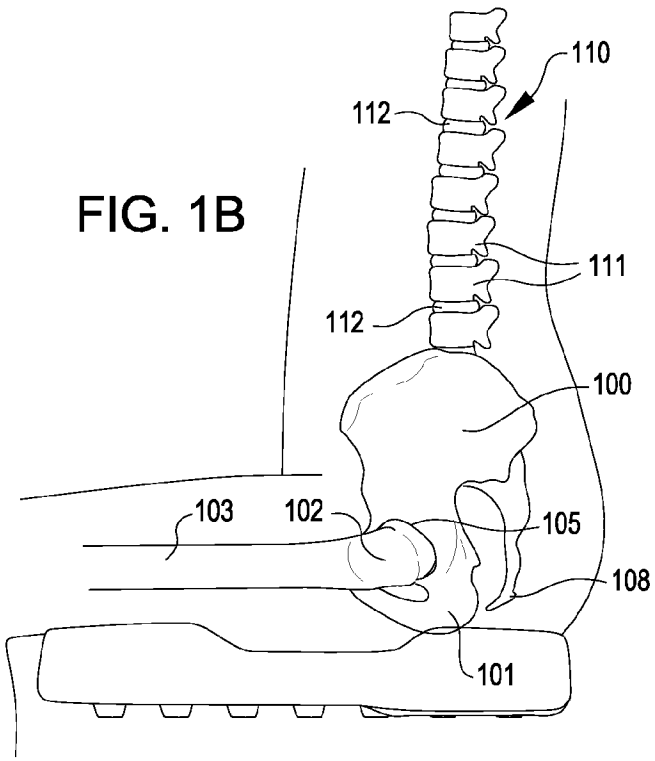
FIG. 1B is a side view of a seated person showing primary anatomical areas of the pelvis supporting the person while sitting on a cushion in accordance with various embodiments.
Figure 1A:
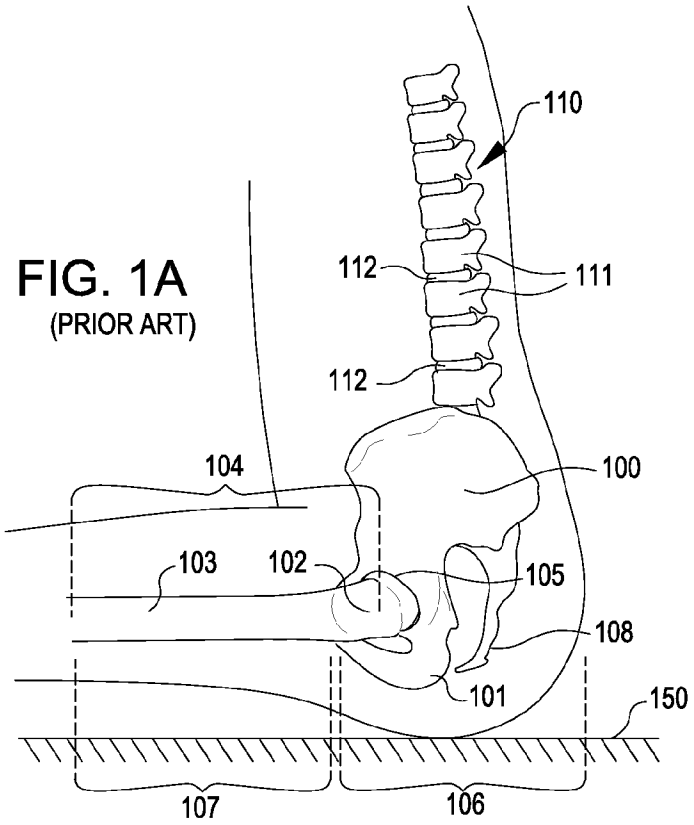
FIG. 1A (PRIOR ART)
FIG. 1A is a side view of a prior art seated person showing primary anatomical areas of the pelvis supporting the person while sitting.

FIG. 1A is a side view of a prior art seated person showing primary anatomical areas of the pelvis supporting the person while sitting. It show the primary anatomical areas of the pelvis that are important in describing how prior art and the current cushions function. There are several primary areas that are important relative to support of the pelvis and the upper torso of a person when in a seated position. The areas that are in contact with the seat cushion are the most important for this discussion. They are formed by a combination of the skeletal components and are of course surrounded by layers of soft tissue resulting in the familiar shapes of the buttocks and thigh.

The skeletal components most associated with supporting the body in a seated posture include the ischial tuberosities 101, greater and lesser trochanter 102 (at the hip Joint) and the long bone of the femur 103. The long bone of the femur 103 and trochanter 102 form the trochanteric shelf 104, an ideal place to shift load for pressure relief at the ischials 101 or coccyx 108 and to also improve lateral stability for the pelvis 100.

The first areas of concern are the two ischial tuberosities (ITs) 101. The IT 101 area of the pelvis 100 is the lowest point of the pelvis 100 when in a seated position. Viewed from the side, the ITs 101 are lower than the hip joint 105. In the average adult, the distance between the lowest point of the ITs 101 and the lowest part of the hip joint 105, the trochanter 102, is approximately 40 mm (1.57"). In addition to being lower, the ITs 101 have very sharp pointed contours. When in the seated posture with the feet supported on the floor, or on wheelchair footrests and the arms supported on armrests, the buttocks 106 and posterior thigh 107 will support approximately 65% of a person's body weight. As an example, a 200-pound person will have 130 pounds of weight distributed on the buttocks and posterior thigh with the peak pressures centered on the IT 101 area. Approximately 80% of all pressure sores for wheelchair users occur at the ischial tuberosities 101.

Another area of possible contact in the seated position is the sacrum and coccyx (tailbone) 108. The coccyx 108 is another sharp bony prominence that is not ideally suited for significant weight bearing and is also an area of increased risk for pressure sores. The coccyx 108 is higher than the ischials so the risk of pressure sores there is not as high as at the ITs unless the person sits in a "slouched" posture, but the risk is still significant.

A further concern is lateral stability of the pelvis 100. The spine 110 has a normal natural curvature at which the muscles supporting it need to do the least amount of work as shown in FIG. 1B, where a user is sitting on a cushion as in present embodiments (i.e., FIG. 1B is not prior art). This normal curvature is generally found when the person is walking with proper posture, standing up straight, or sitting up straight. However, all people tend to slouch or relax their posture at least slightly upon sitting down. As seen in FIG. 1A, this causes pelvic retrusion, where the pelvis 100 rotates slightly backward, causing the bottom of the pelvis 100 to move in an anterior direction, the top of the pelvis 100 to move in a posterior direction, or some combination of both movements. Since the spine 110 is attached to the pelvis 100, this pelvic retrusion causes the spine 100 to straighten and undergo a change in alignment of various vertebrae 111 away from the normal curvature of spine 110. As a result, muscles react between vertebrae in the spine, activating to urge the vertebrae back toward normal alignment. This muscle activation lasts the entire time the misalignment persists. The muscles thus must work harder to support the spine in this misaligned position, leading to muscle fatigue. The muscles may also experience further strain due to pressure exerted between misaligned vertebrae. The muscle fatigue and strain resulting from misalignment can lead to substantial lower back pain.

Prior Art Seat Cushion Designs

Prior art wheelchair seat cushions come in a wide variety of designs, from a simple piece of polyurethane foam to very complex cushions with multiple density foams, foam and flexible gel layers or fluid bladders (air and/or viscous fluid). However, two primary design considerations are common to all cushions regardless of specific variety: heat buildup and pressure distribution.

Heat build-up in cushions is a design consideration because the support medium and cover materials used in wheelchair seat cushions may act as good insulators. The human body is warmer than average room temperature creating a situation where the heat of the body starts to warm the cushion when a person sits down. Since the cushion acts like an insulator, the heat is deflected back up to the body creating a rise in skin temperature. In a room at a customary ambient temperature of approximately 22° C. (72° F.), average skin temperature is about 24° C. Skin temperature at the seat cushion interface usually reaches 35°-37° C. in 60-120 minutes. As skin temperature increases to around 31° C. the body responds by increasing sweating in an effort to control heat buildup and maintain a constant core temperature. The point at which the body triggers this sweating is called the perspiration threshold. Moisture is caused by the skin reaching the perspiration threshold, triggered by heat.

Heat build-up and sticking clothing can be annoying, but for most people, it does not pose a serious health risk. However, for people that use wheelchair cushions, heat build-up is a primary factor for increased risk of developing pressure sores. The top three contributing factors are peak pressure at areas of high risk, heat, and moisture. Pressure applied to the skin and soft tissue closes off the capillaries and the soft tissue can die from lack of oxygen and/or nutrients. Moisture softens the skin and makes it more susceptible to physical damage. Heat causes a rather dramatic increase in cellular metabolism. As skin temperature increases 1° C., the metabolic demand increases 10%. The increase in metabolism means that the cells need more oxygen as the temperature increases and the soft tissue can die from lack of oxygen. Since skin temperature dramatically affects skin integrity, it is very important to prevent skin temperature build-up in wheelchair cushions.

To address the pressure issue, most cushions support the body by allowing the body mass to sink into or immerse into the cushion. The first points of contact are the ischials. Cushions that are successful in providing comfort and decreasing the risk of pressure sore development thus all have a common design requirement of redistributing pressure away from the sharp boney prominences of the ischials and shifting those pressures to the rest of the seated support surface at the hips and trochanteric shelf.

There are three ways in which a cushion can support a person. The most common is that the shape of the cushion changes with the applied load. The vast majority of cushions work in this way. Cushions made from resilient foams will compress allowing the body to sink into or immerse into the cushion. This allows the cushion to change shape and adapt to the user. Some cushions have a fluid interface with the user. In this configuration, the fluid will move out of the way of high pressure and flow to areas of low pressure as it attempts to equalize support.

The key to the function of these cushions is that the material used to fabricate the cushions has the ability to change shape under load. The foam compresses or the fluid moves. When foam is compressed the elastic properties of the foam offer some resistance to compression as it changes from a flat sheet to a contoured surface. The resilient nature of the foam behaves like a series of springs standing on their ends, much like a mattress is constructed. As load is applied to a foam wheelchair cushion the first "springs" that would be compressed would be the ones under the IT areas and they would compress the furthest as load is applied over the entire cushion surface. Coil springs increase resistance the further they are compressed. The spring-like quality of polyurethane foam responds the same way. The pressure required to compress the foam increases as the foam is compressed. Since the foam is compressed the most under the ischials, the pressure is greater at those areas.

Another way to achieve the same type of pressure distribution and comfort is to design the cushion with a fluid interface. A fluid interface could either be a gas or liquid. Both materials are fluid in while different in physical properties. It is the nature of a fluid to move away from areas of high pressure and move to areas of low pressure. This allows the fluid cushion interface to allow immersion but also to provide greater levels of envelopment as the cushion forms to the shape of an object pushing against it. Cushions fabricated with multiple air bladders may have all of the air bladders interconnected. When a person sits on such a cushion, the air (gaseous fluid) is moved away from areas of high pressure and travels to areas of low pressure. This tends to equalize the pressure over the complete seating surface area and reduces peak pressure at areas of high risk. Fluid cushions that use a liquid instead of a gas follow the same laws of physics and will also move away from areas of high pressure and fill in areas of low pressure. Due to the higher viscosity of most fluids as compared to gases, liquid fluid cushions tend to adapt to the shape of the user slower than air filled cushions. This may improve stability, but the pressure relief principles are the same.

A second type of wheelchair cushion combines the resilient materials (foam or fluids) with a cushion shape that is pre-contoured to match a generic anatomical shape of a seated person. As an example, when a person sits on a soft moldable surface like sand or snow and then carefully gets up, there will be an imprint in that soft substrate that represents a normal anatomical shape. The contours will be lower underneath the IT area and will round upwards around the buttocks and will have two elongated troughs where the surface was compressed by the thighs. One of the ways to reduce the peak pressure build up under the IT area and to provide more comfort overall is to pre-contour the cushion so that the cushion does not have a flat top surface. This allows the cushion supporting the body by starting out with a shape that closely matches a general human anatomy. A cushion is pre-contoured if it is fabricated with a top shape that mimics the same general shape of the buttocks and thighs that is found in a seated person. When a cushion has this generic pre-contoured configuration, the support medium does not have to compress as much to match the shape of the user and pressures can be redistributed to the trochanteric shelf and away from the ischials more efficiently.

A related method for transferring load away from the areas of peak pressure and improving pressure distribution and comfort is to fabricate the cushion from a variety of materials that provide a firmer surface underneath the trochanteric shelf and a softer surface underneath the ischial area. Using this multi-Density foam technique is rather common in the wheelchair cushion industry. This can be done with a flat or precontoured cushion but still relies on the same principles of cushion support outlined above.

A third method of redistributing pressure is to fabricate the cushion to the exact shape of the individual user. In this technique, the person is positioned on a cushion that has been molded to their specific shape and posture. There are several techniques to accomplish this but the end result is that the cushion and person have the same shape. Because the dimensional differences between the ischials and trochanteric shelf are addressed and there is a lot of surface area bearing load, there is usually little need for the cushion to change shape or allow immersion to accommodate the boney prominences of the user. This technique is very good, but the process can be time consuming and very expensive and is prone to fitment problems if the user grows or changes shape by gaining or losing weight.

Seat Cushion Embodiments:

Cushions in accordance with current embodiments use single-density closed cell foam, such as EVA foam. EVA is a polymer that approaches elastomeric materials in softness and flexibility, yet can be processed like other thermoplastics. The material has good clarity and gloss, barrier properties, low-temperature toughness, stress-crack resistance, hot-melt adhesive water proof properties, and resistance to UV radiation. EVA has little or no odor and is competitive with rubber and vinyl products in many electrical applications. Although EVA foam is one type of closed cell foam that can be used, other closed cell foams can be used for cushions in accordance with embodiments herein. This type of foam is similar to the type of foam used to make "flip-flop" sandals and similar products. The foam has several advantages over standard polyurethane and memory foams in that it is lightweight, very durable and completely waterproof (the waterproof feature is very important for wheelchair cushions). The reason that this type of foam has not been used for wheelchair cushions is that it is not very resilient. Unlike polyurethane foams that are designed to have a lot of elasticity, the foams in cushions of current embodiments only allow a very small amount of immersion. This low level of immersion produces a response to load that is the opposite of the common foam and fluid wheelchair cushions. The lack of resiliency would not matter much if the present foam was used to produce cushions that are molded to the exact shape of the user, but the lack of compressibility does not work well with a more generic cushion configuration that requires a lot of immersion. However, a pre-contoured wheelchair cushion produced in the traditional manner but using closed cell foam instead of a polyurethane foam will not allow sufficient immersion to pass the Medicare required testing for coding as a wheelchair cushion.

Thus, in order to use single density closed-cell foam to achieve the pressure redistribution characteristics found in more traditional cushions, the design of the present cushion is dramatically different. Instead of relying on the elastic properties of the foam materials to allow immersion, the cushion itself changes shape and conforms to the load and contour of the individual user. To achieve the redistribution of pressure found in other cushion designs, applicants herein designed a cushion so that it responds to the applied load of the user by actually changing shape. To clarify, the standard polyurethane foam cushion changes shape only through compression. The closed cell cushion material in accordance with current embodiments is shaped so that it not only allows compression, but the cushion is shaped to provide a dynamic response in which it bends and flexes before receiving a full load, and thus the structure of the molded foam allows the cushion to "bend" around the applied load. Whereas pre-contoured top surfaces of other commercial wheelchair cushions may rely on both their pre-contour and compressibility to achieve their pressure distribution, such cushions are not using pre-contouring, compression, and bending to achieve a dynamic redistribution of pressure away from the areas of high pressure to areas of lower pressure as in current embodiments which incorporate a pre-contoured top surface not unlike other commercial wheelchair cushions.

In addition to pressure redistribution, the dynamic bending and shaping of the cushion to a user is further beneficial for its effect on lateral stability of the pelvis. Because the substantial compressibility of other foam cushions responds to load by compressing to allow immersion, such cushions do not resist pelvic retrusion due to slouching. In contrast, since a cushion of present embodiments bends into a new shape under load and has minimal compressibility, it will provide resistance to pelvic retrusion, thereby helping maintain the spine in its natural curvature, which may prevent significant back pain from an uncorrected prolonged pelvic retrusion and straightened spine.

Figure 2:
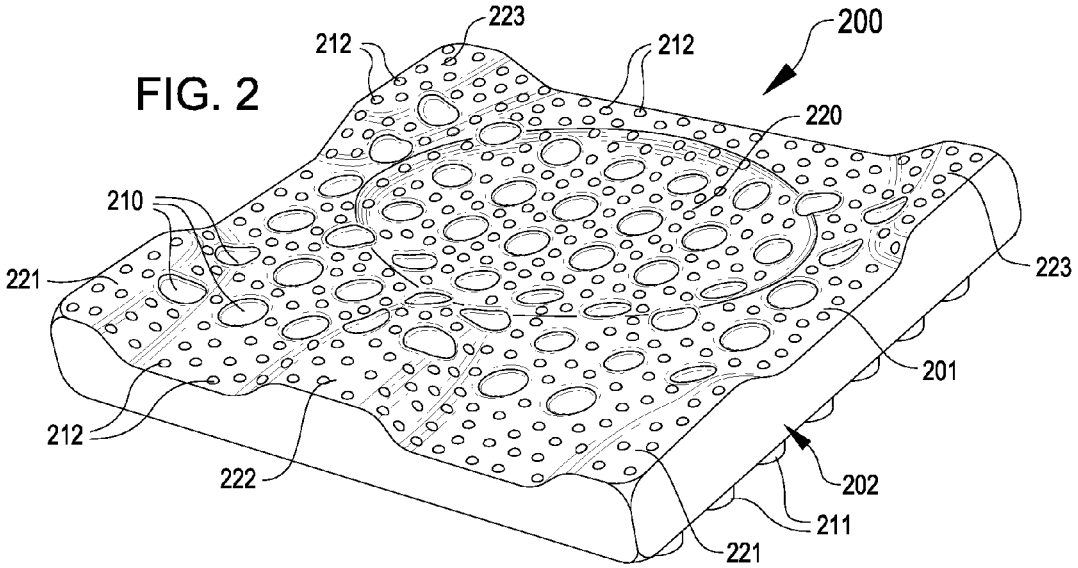
FIG. 2 is a top perspective view of a cushion in accordance with various embodiments
Figure 3:
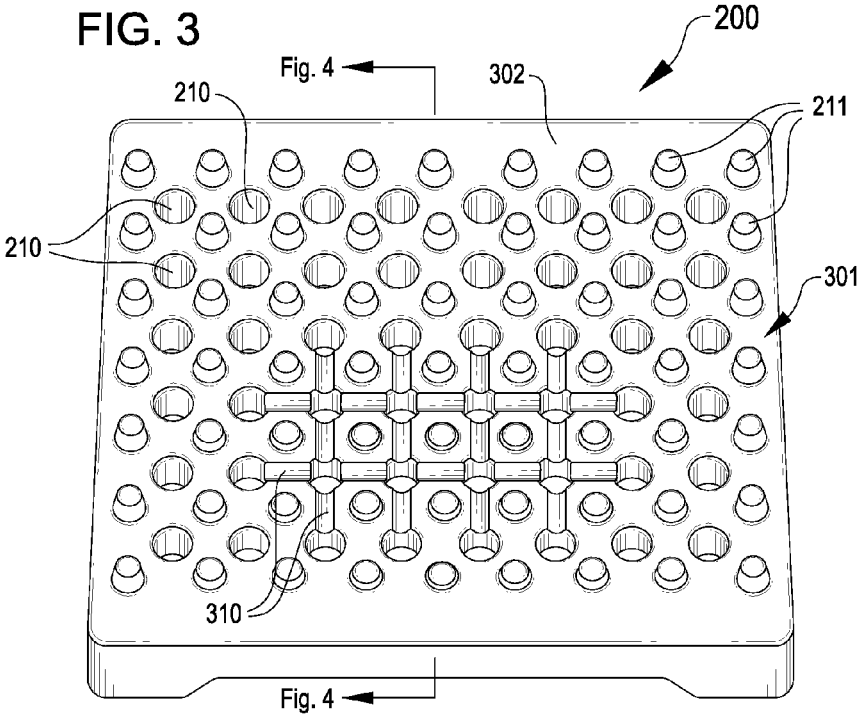
FIG. 3 is a bottom perspective view of a cushion in accordance with various embodiments.

Referring now to the drawings, in which like reference numerals represent like parts throughout the several views, FIG. 2 shows a top perspective view and FIG. 3 shows a bottom perspective view of a cushion 200 in accordance with various embodiments. The cushion 200 has a top sitting face 201 which contacts the user's body and conforms to it when the user sits on the cushion, a bottom supporting face 301 which contacts the support surface 150 at various points, and a cushion body 202 which connects the top sitting face 201 and the bottom supporting face 301. The points which contact the support surface 150 when a user sits on the cushion 200 will depend upon the weight and body shape contour of the user.

As best seen in FIG. 2, in some embodiments, the top sitting face 201 has a pre-contoured configuration which includes contoured areas formed so that the cushion, without load, is already contoured to meet the general anatomical shape of a person when in the seated position. For example, the cushion 200 can have a contoured depression or pelvic well 220 shaped for receiving the ITs 101 of a user. While the shape of this well shown in FIG. 2 is elliptical, the well 220 can be any other shape, including, but not limited to, both shapes that are symmetrical (such as circles, triangles, squares, and other common polygons) and shapes that are not symmetrical (e.g. with a left side of the shape larger or otherwise shaped differently from a right side, a front part of the shape larger or otherwise shaped differently from a back side, or any other non-matching combination of parts). The cushion can also have outer or lateral thigh ridges 221 for aligning and supporting the thighs of a user from a lateral position. These outer thigh ridges 221 also can be shaped alike or shaped differently. The cushion can also have one or more inner or medial thigh ridges 222 at the front of the cushion for aligning and supporting the thighs of a user from a medial position. These inner thigh ridges 222 also can be shaped alike or shaped differently. The cushion can also have one or more buttocks or lateral hip ridges 223 at the back of the cushion for aligning and supporting the buttocks and/or lateral hip portions of a user in a seated position. These buttocks ridges 223 also can be shaped alike or shaped differently. As may be appreciated in FIGS. 1B and 5, such general contours can also provide additional support to a user's body to supplement the resistance to pelvic retrusion provided by the dynamic bending and shaping response of cushion 200, thereby assisting in orienting the spine 110 toward its natural curvature.

In various embodiments, the dynamic bending and shaping response to load of cushion 200 is accomplished by special configuration of ventilation holes such as port 210 and spacing members such as pillar 211. Standard port and pillar technology is described in U.S. Pat. No. 7,695,069, entitled "Seat Cushion", and incorporated herein by reference.

Figure 4:
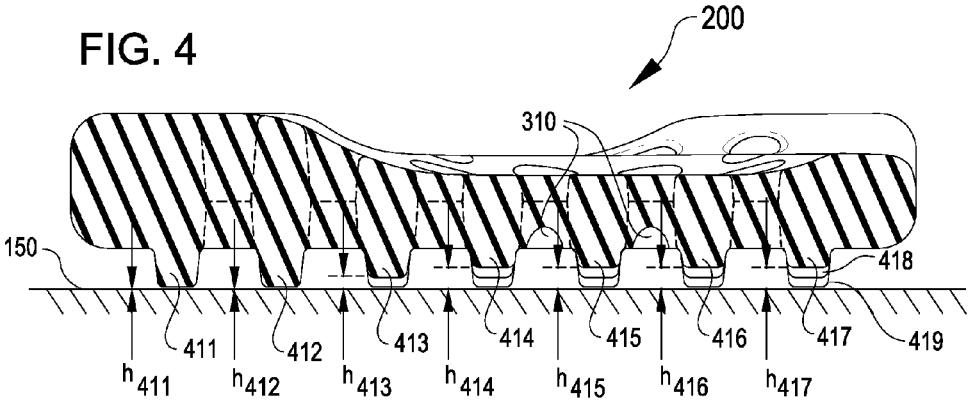
FIG. 4 is a section view of a cushion in accordance with various embodiments.

As part of the special configuration, support pillars on the cushion 200 are of different heights on supporting face 301 (e.g., in the embodiment shown in FIG. 4, pillars 411 and 412 are each taller than each of pillars 413-417). The supporting face 301 includes a bottom 302 of the body 202 which is generally flat, with these pillars attached to this flat bottom 302. Thus, in an unloaded state of cushion 200, not all pillars contact the support surface 150 on which the cushion 200 is placed (e.g., in the embodiment shown in FIG. 4, each of pillars 413-417 have a nonzero height—$h_{413}$-$h_{417}$, respectively—of the distance between the bottom of the pillar and the support surface 150, while pillars 411 and 412 have $h_{411}=h_{412}=0$ because each is touching the support surface 150).

Figure 5:
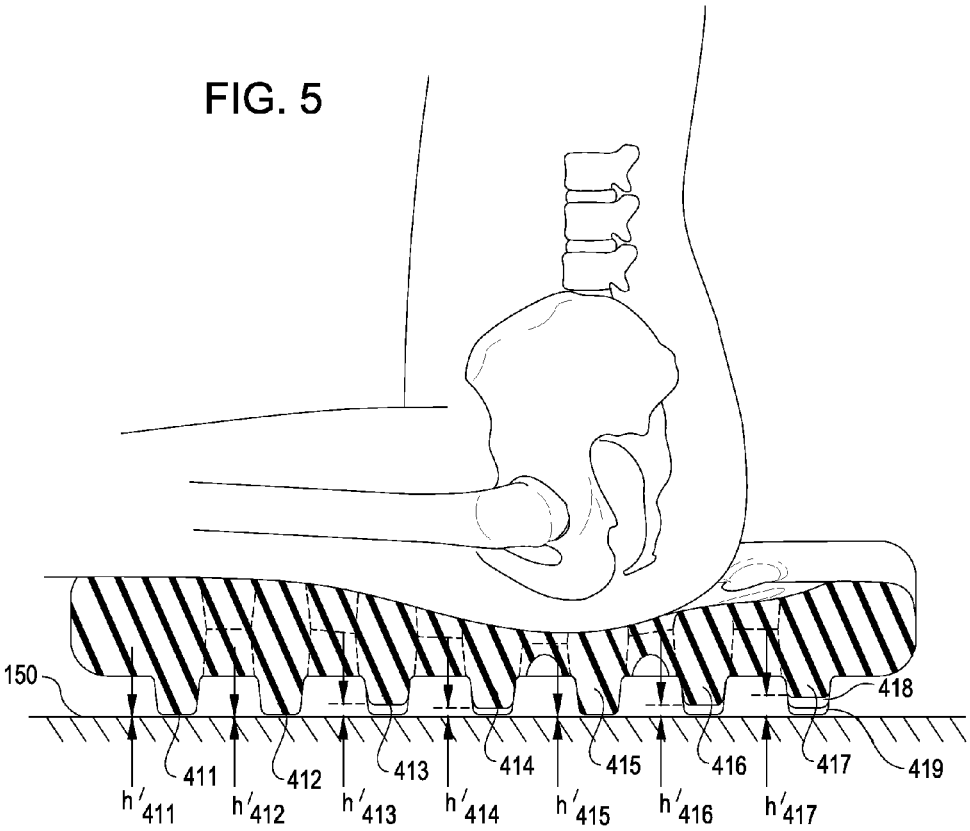
FIG. 5 is a section view of a cushion supporting a person in accordance with various embodiments.

However, in embodiments, as the cushion 200 receives a load, the cushion 200 bends so that some of the shorter pillars are moved closer to the support surface 150 (e.g. in the embodiment shown in FIG. 5, pillars 413-416 are moved such that each of $h'_{413}$-$h'_{416}$ is less than each of $h_{413}$-$h_{417}$, respectively). Among those pillars, some may be pressed down into contact with the surface 150 (e.g., in the embodiment shown in FIG. 5, for pillar 415 $h'_{412}=0$). It is also possible that other pillars will not move relative to supporting surface 150 at all (e.g., in the embodiment shown in FIG. 5, for pillar 417, $h'_{417}=h_{417}$). Thus the cushion 200 bends and flexes under the particular load and contour of the user's body to provide an additional contouring of the cushion over prior art cushions, which helps to distribute the load more appropriately to high pressure areas on the user's body.

As may be appreciated from FIG. 5, the amount of bending and the determination of which pillars will actually contact the support surface when a user is supported by cushion 200 will both depend on the specific weight and body contour specifics of the user as well as the configuration of pillar height of the particular embodiment. Thus, the height selected for pillars on the supporting face 301 may be varied individually or as part of a larger pattern in order to create different embodiments of cushion 200 for different users or groups of users. For example, in embodiments such as that shown in FIG. 4, the pillars on the cushion are very short underneath the pelvic well 220 and gradually become longer as the cushion contours travel out toward an area for supporting the trochanteric shelf 104 of a user and forward toward the front of the cushion 200. As described earlier, the ischial area 101 is first to contact the cushion. A pattern may also vary height in a lateral direction, as best seen in the embodiment of FIG. 4, wherein short pillar 417 may be seen in front of medium pillar 418 and tall pillar 418.

As may be best seen in FIG. 3, in embodiments, the cushion 200 can also have troughs 30 on the supporting face 301 to make the cushion 200 bend and flex more easily. In many embodiments, the troughs 310 are rounded and run between the pillars to provide areas of strain relief by decreasing surface tension on the supporting face 301 of cushion 200, thereby lowering the force needed to cause the cushion 200 to bend and flex in response to load and decreasing the need for the supporting face 301 to stretch in those areas. The troughs 310 can be arranged in a column and row pattern. The cushion 200 can have troughs 310 between all or only some of the rows, and the troughs 310 may extend from one edge of cushion 200 to the other, or may only be positioned in selected locations. In some embodiments, the troughs 310 only run between the shortened pillars on the supporting face 301 of the cushion 200. The troughs can also be positioned only in locations of maximum surface tension, or can extend over the entirety of the cushion, or any subset thereof. For example, as shown in the embodiment of FIG. 3, the supporting face 301 of the cushion 200 has rounded troughs 310 in a column and row pattern only under the pelvic well 220 of the cushion 200.

As best shown in FIG. 2, cushion 200 may also include a plurality of nubs 212 spread out across the sitting face 201. These nubs 212 can provide a desirable additional tactile characteristic to cushion 200 and are thought to stimulate nerve activity and improved blood circulation in the portion of a person's body placed in contact with them. Additionally, the nubs 212 may be included to improve performance of a cushion cover (not shown). For example, if a cushion cover is placed over a cushion 200, when a user is not pressing the fabric of the cover into the cushion seating face 201 by sitting on it, the nubs may provide sufficient separation between the cushion cover and the cushion 200 so as to provide airflow there between to allow more rapid cooling or drying of the cover due to increased airflow and convection.

Any suitable method of manufacturing or fabricating the cushion 200 can be used. For example, in some embodiments, the cushion 200 may be formed in two general sections, a top section and a bottom section, where the top section is a perforated core which is molded onto the lower section made up of pillars with different heights. In some embodiments, the cushion 200 is injection molded as one piece, including the pillars 211. In addition, if desired, voids can be added to selective sections of the cushion 200 to aid in molding, the reduce the amount of mold material used, and/or to provide selective flexibility of the cushion.

Furthermore, the cushion 200 can be adapted for a variety of uses. While many embodiments herein describe the cushion adapted for use in a wheelchair to prevent pressure sores, the cushion 200 can be used in any situation where a person will be sitting or in any situation where a person may support even a portion of their weight or a body part relative to a support surface. Examples include, but are not limited to, use of the cushion with office chairs, home furniture, stool, automobiles, trains, airplanes, boats, tractors, motorcycles, bicycles, unicycles, tricycles, recreational vehicles, dune buggies, jet skis, stadium seats, spacecraft, hovercraft, ski lifts, roller coaster, glider, luge, bobsled, recliners, gurneys, beds, yoga mats, pet crate liners, gardening knee mats, or any other kind of cycle, vehicle, seat, or furniture.

Orthotic

In one such adaptation, an orthopedic orthotic is provided. Such an orthotic may be incorporated into footwear to provide the footwear with improved support for a wearer's foot or to urge the wearer's foot into an alignment desired for treatment of ailments stemming from the structure and alignment of components of a patient's muscular and skeletal systems.

By way of introduction to the uninitiated, orthopedic orthotics are a well known art. Generally, such orthotics come in the form of inserts placed in shoes or other footwear. Orthopedic orthotics provide support for the foot by distributing pressure or realigning foot joints while standing, walking or running Orthopedic orthotics are often specially fitted for an individual. The accompanying process of modeling a person's foot and custom-fabricating a corresponding prescription orthotic is often expensive and time-consuming, but such individually customized prescription orthotics are generally considered as providing the best results in the art. However, many generic orthopedic orthotics—which are designed to match the contours of a generic foot shape—are also widely available as a more expedient and economic alternative to custom orthopedic orthotics.

In addition, existing orthopedic orthotics suffer other drawbacks. For example, because the orthotic is generally in intimate contact with a foot and enclosed within a shoe, heat buildup and accompanying perspiration of the foot can occur. This perspiration may become absorbed in the orthotic or shoe, causing undesirable and irremovable odors which result in a shortened useable lifespan of the orthotic or shoe. Moisture and heat may also lead to diminished skin integrity, resulting in sores and the like. Although some orthotics are equipped with holes in an effort to allow airflow to ameliorate these conditions, the ventilation achieved is generally inadequate. Further drawbacks can include limited useable lifespan and high expense resulting from the materials used in either prescription or generic orthotics. For example, many generic orthotics are only rated for a 3-6 month useable life.

Figure 6:
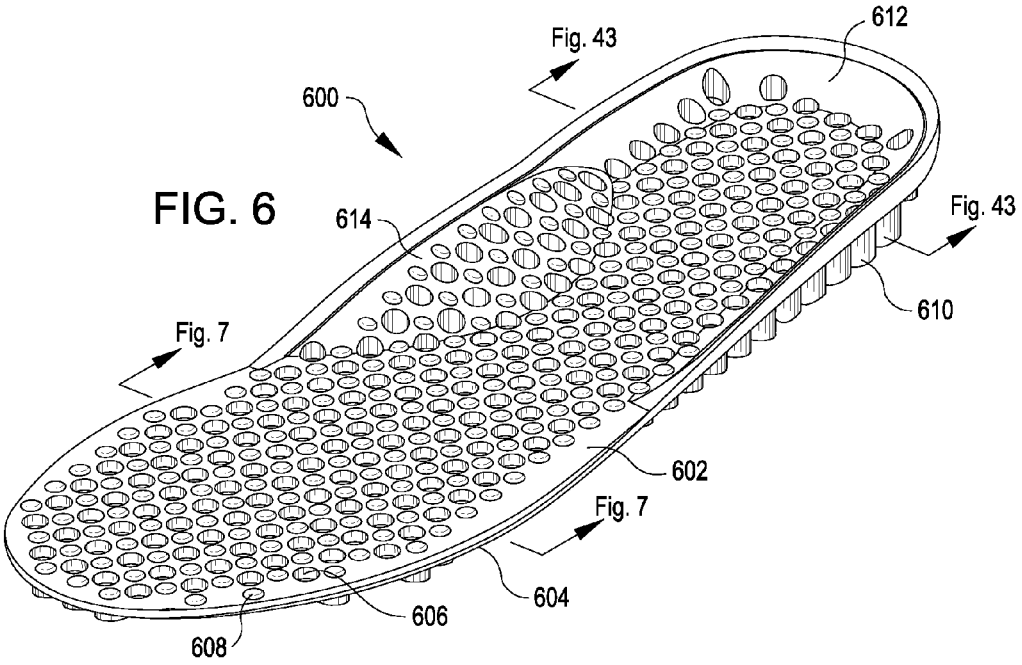
FIG. 6 is a top perspective view of an orthotic in accordance with various embodiments.

In several embodiments of the present disclosure, an orthotic shoe insert is provided with ventilation holes and supports which offset the bottom surface of the orthotic from the insole or footbed of a shoe. Referring again to the drawings, FIG. 6 shows a top perspective view of an orthotic 600 in accordance with various embodiments. The orthotic 600 can have a plurality of holes or ports 606, each of which passes through top surface 602 of orthotic 600 and through bottom surface 604. A plurality of supports 610 can provide the support necessary to offset the bottom surface 604 of the orthtoic 600 from the insole or footbed of a shoe in which orthotic 600 is installed. The combination of the holes 606 and the supports 610 can provide improved airflow to a wearer's foot. The offset achieved by the supports 610 (shown in the form of pillars in FIG. 6) can allow air to pass between the bottom surface 604 of the orthotic 600 and the shoe footbed, unlike other orthotics which preclude such substantial airflow as a result of the direct contact between the orthotic and the shoe footbed. Furthermore, the holes 606 can provide a path by which the air between the bottom surface 604 of orthotic 600 and the shoebed can directly ventilate the wearer's foot, providing an avenue for heat and moisture to escape.

Figure 7:
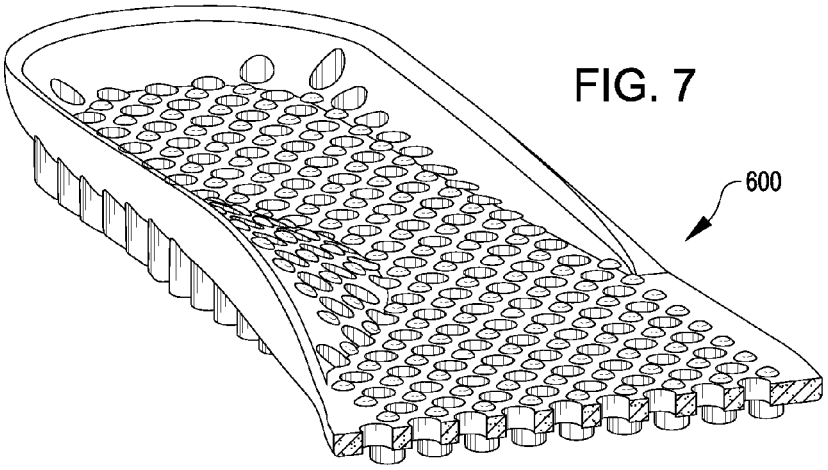
FIG. 7 is a top perspective view of an orthotic having a truncated length in accordance with various embodiments.

FIG. 7 shows a top perspective view of an orthotic 600 having a truncated length in accordance with various embodiments. In various embodiments, orthotic 600 can have a truncated length, and does not extend the full length of the shoe.

Figure 8:
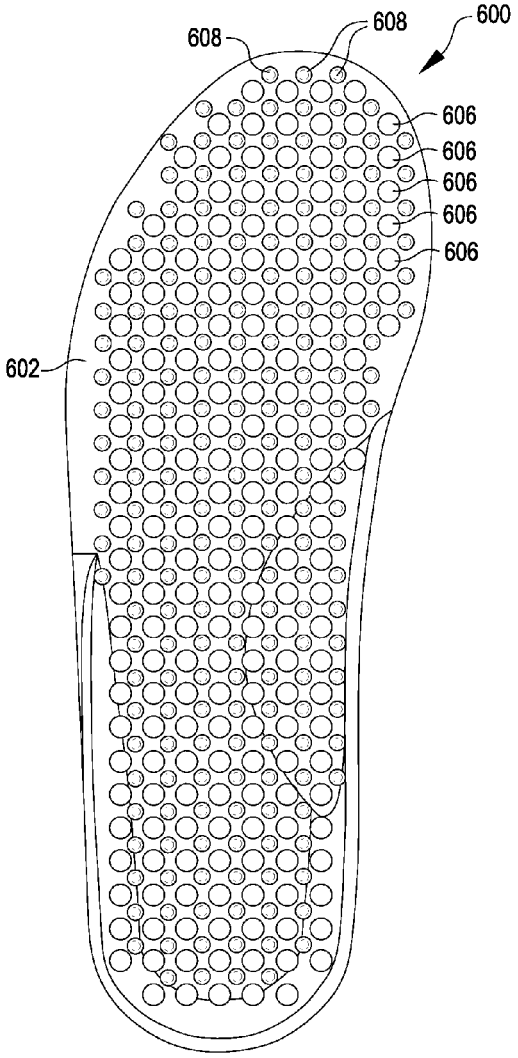
FIG. 8 is a top view of an orthotic in accordance with various embodiments.

FIG. 8 is a top view of an orthotic in accordance with various embodiments. As shown in FIG. 8, in various embodiments, orthotic 600 has a plurality of nubs 608 interspaced among holes 606. These nubs 608 can provide a desirable additional tactile characteristic to orthotic 600 and are thought to stimulate nerve activity and improved blood circulation in the portion of a person's foot placed in contact with them. Additionally, the nubs 608 may be included to further improve ventilation of an orthotic 600. For example, when a user is not putting weight on the orthotic 600 (such as when in a sitting position with feet raised or with legs crossed and one foot in the air) the nubs 608 may provide sufficient separation between the wearer's foot and the orthotic so as to provide airflow there between to allow more rapid cooling or drying of the wearer's foot due to increased airflow and convection.

Figure 9:
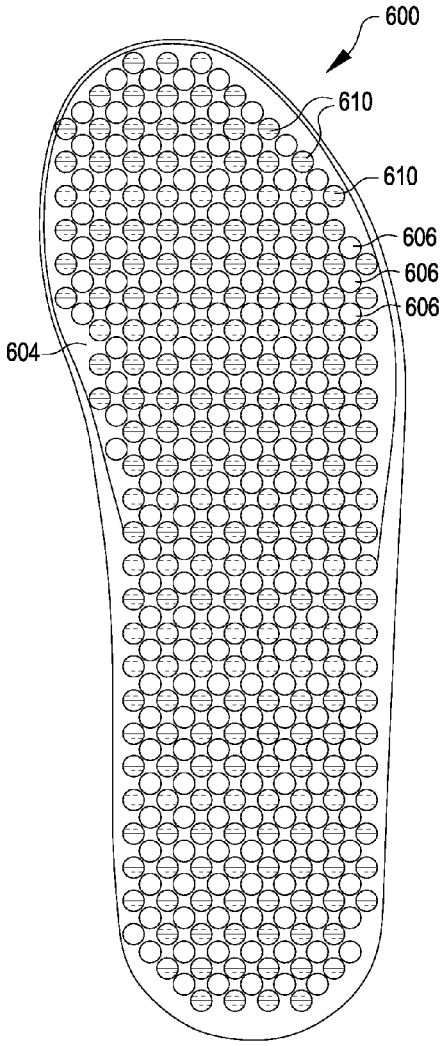
FIG. 9 is a bottom view of an orthotic in accordance with various embodiments.

FIG. 9 is a bottom view of an orthotic in accordance with various embodiments. As shown in FIG. 9, in various embodiments, pillars 610 are interspersed regularly between holes 606 such that holes 606 and pillars 610 always alternate with one another. Such prolific holes 606 and pillars 610 provide significant support and ventilation; however, other embodiments are available in which holes 606 and pillars 610 do not always alternate with one another.

Figure 10:
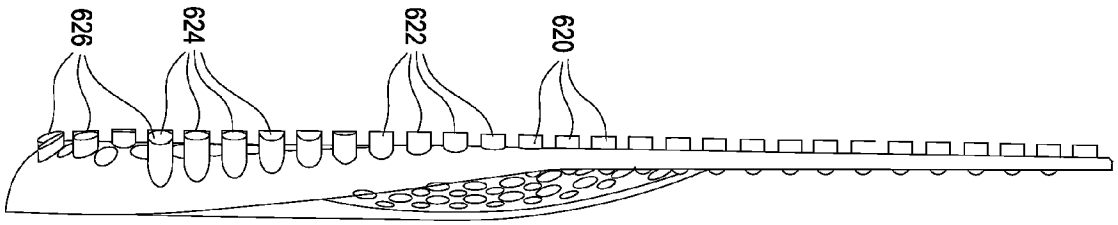
FIG. 10 is a side view of an orthotic in accordance with various embodiments.

FIG. 10 is a side view of an orthotic in accordance with various embodiments. As shown in FIG. 10, pillars 610 can be of varying heights. For example, some pillars (e.g., 622) may be taller than other pillars (e.g., 620) as a result of varied contouring of the bottom surface 604 of orthotic 600. Additionally, some pillars (e.g., 624) may vary in height from other pillars (e.g., 620 or 622) in order to allow portions of the orthotic 600 to bend in response to load to conform to the wearer's foot and/or shoe. Furthermore, in various embodiments some pillars do not have flat bottom surfaces, but instead have angled bottom surfaces 626 configured to improve conformity of the orthotic 600 to the shoe footbed or insole. In some embodiments, pillar bottoms can be cut or otherwise customized to fit certain shoes or adjust function of the orthotic 600.

Figure 11:
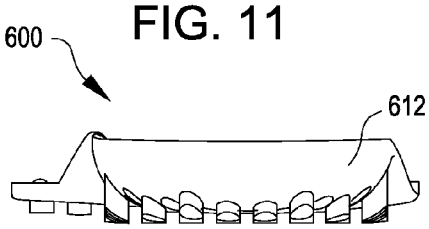
FIG. 11 is a back view of an orthotic in accordance with various embodiments.

FIG. 11 is a back view of an orthotic 600 in accordance with various embodiments. As shown in various figures, including FIG. 11, in various embodiments, orthotic 600 comprises a heel cup 612. Heel cup 612 can provide additional foot stability for a wearer and provide a more secure fit of the orthotic 600 into a shoe.

In various embodiments, orthotic 600 includes in-step 614. The supported contour of in-step 614 provides arch support for the arch of a wearer's foot. The contour of in-step 614 can be achieved by increasing the thickness of the orthotic 600 in the in-step 614 region, by increasing the height of pillars underneath the in-step 614 region, or some combination of both.

Figure 43:
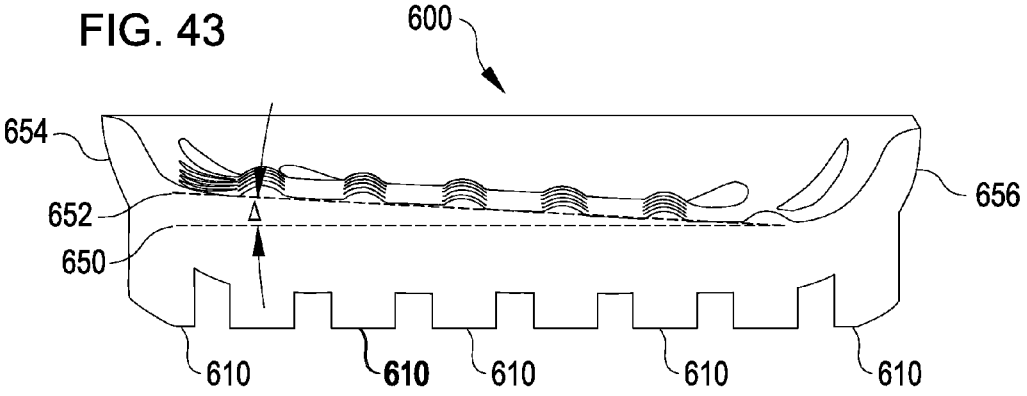
FIG. 43 is a cross-sectional front view of an orthotic in accordance with various embodiments.

FIG. 43 is a cross-sectional front view of an orthotic 600 in accordance with various embodiments. In various embodiments, the orthotic 600 may include a lateral taper such that a first lateral side of the top surface 602 (depicted in FIG. 6) is of a different elevation than a second lateral side of the top surface 602. For example, an inner foot lateral side 654 may be higher than an outer foot side 656. In some aspects, the lateral taper may be provided by a differing thickness of material of the orthotic 600, as shown in FIG. 43. In other aspects, the lateral taper may be provided by differing heights of pillars 310. The taper may be a uniform amount. For example, the top surface 602 may include a portion that is aligned with a reference plane 652. The reference plane may be angled away from a horizontal plane 650 by an amount Δ. In some embodiments, the amount Δ of lateral taper is approximately 4 degrees. Although such an amount of taper has been generally found beneficial in providing a wearer of the orthotic 600 with improved alignment of the wearer's feet, legs, and/or hips relative to one another, other angles (including, but not limited to, angles greater than 4 degrees, less than 4 degrees, zero degrees, and negative angles, which would correlate to an inner foot lateral side 654 that is lower than an outer foot side 656) may be utilized for the amount Δ according to the particular features of an anticipated wearer.

In various embodiments, various features described herein have geometry modified from that shown in the drawings. For example, in some embodiments, at least some holes 606 are not circular, but have a different shape, such as oval. In some embodiments, supports 610 are not circular pillars, but comprise a different shape, such as but not limited to oval pillars, ridges extending lengthwise along the bottom surface 604 of orthotic 600, or cubes.

Additional benefits of the orthotic 600 can be appreciated given the high likelihood that the orthotic 600 will undergo substantial exposure to perspiration. The holes 606 in the orthotic 600 can allow sweat to pass through the orthotic 600, providing additional surface area for convection to work to evaporate the perspiration. Additionally, in many embodiments the orthotic 600 is made with non-absorbent and completely washable material (for example, EVA foam, such as described above). Use of this material permits the orthotic 600 to be easily rinsed free of perspiration, unlike some other orthotic that tend to absorb the perspiration in a material that is difficult to effectively clean.

Furthermore, other adaptations of the orthotic 600 are also possible. For example, in some embodiments of the orthotic 600, the orthotic 600 may be integral with a shoe. In one particular example, a sole may be attached as a footbed to the bottom of the plurality of supports 610 (e.g., via an adhesive, a heated bonding process, or as part of a single molded object) and a strap arranged over the top surface 602 to provide a sandal or "flip flop" with an integral orthotic 600.

Sleeping Surface Cushion Overlay

In another adaptation, a sleeping surface cushion overlay is provided. Such an overlay can be utilized with a sleeping surface to provide additional support and improved ventilation to the sleeping surface.

By way of introduction to the uninitiated, mattresses are frequently designed to provide a particular level of firmness or support for a person while sleeping. However, a wide variety of products exist, sometimes called "mattress toppers" or "overlays," which can be placed on top of a mattress in order to adjust the softness or other characteristics of the sleeping surface. Such overlays are often easily removable from the mattress and can also be effectively hidden by the use of fitted sheets and the like. Frequently overlays primarily serve as additional cushioning; however, overlays may also be used to provide a waterproof layer in an effort to protect the underlying mattress.

The healthcare industry often uses mattress overlays for this latter purpose. Commonly, a hospital bed mattress will be provided with a layer of plastic underneath the sheets so as to protect the mattress from moisture from the inadvertent urination or defecation of patients which would otherwise tend to seep into the mattress and ruin it. While this is an effective precautionary measure that prevents the need to constantly replace mattresses, this practice does have drawbacks. In addition to preventing the passage of moisture, the plastic often also prevents effective dissipation of heat, reflecting the heat back toward the patient instead of allowing the heat to pass into the mattress. Such heat buildup can contribute to a number of ailments, including bedsores. Even mattress overlays which are not water-proof and which are used primarily for improved support or comfort can also present heat buildup issues, as the overlay often acts as a further insulating layer that may slow heat dissipation.

Figure 12:
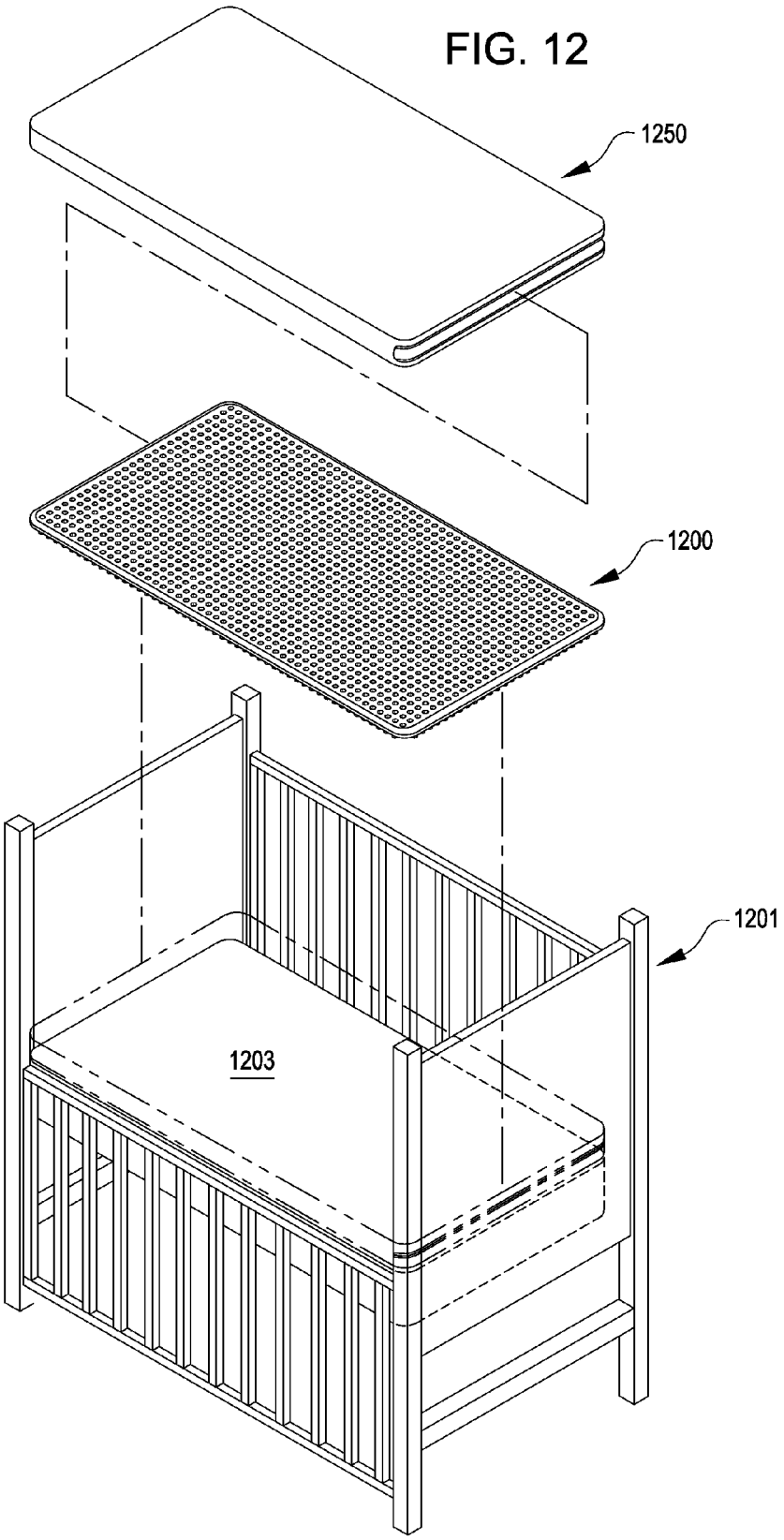
FIG. 12 is an exploded assembly view of a crib mattress overlay, overlay cover, and crib in accordance with various embodiments.
Figure 13:
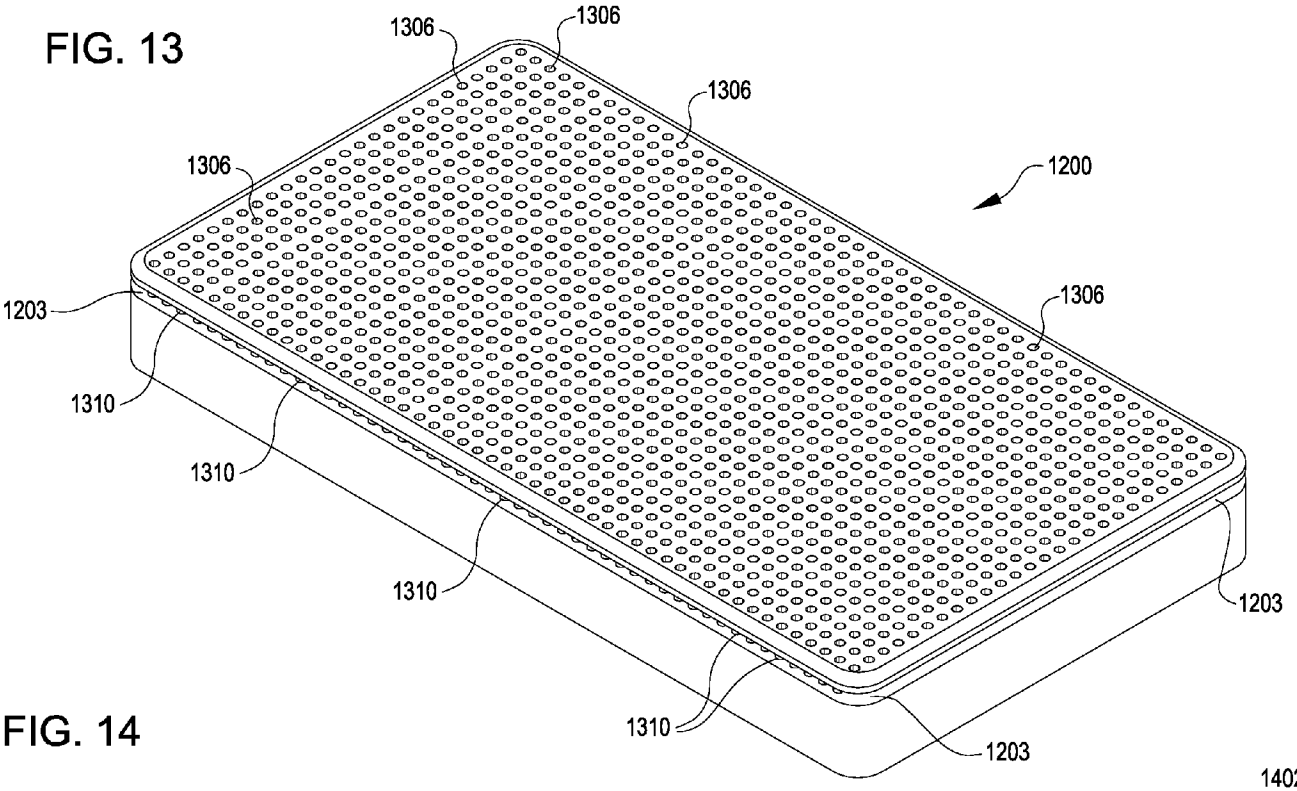
FIG. 13 is a top perspective view of a sleeping surface overlay in accordance with various embodiments.

In several embodiments of the present disclosure, a sleeping surface cushion overlay is provided with ventilation holes and supports which offset the bottom surface of the sleeping surface cushion overlay from the sleeping surface. Referring now to the drawings, FIG. 12 shows an exploded assembly view of a crib mattress overlay 1200 with an overlay cover 1250 installed in crib 1201 in accordance with various embodiments. As shown in FIGS. 12-16, crib mattress overlay 1200 can have a plurality of holes or ports 1306, each of which passes through top surface 1402 of crib mattress overlay 1200 and through bottom surface 1404. A plurality of supports 1310 can provide the support necessary to offset the bottom surface 1404 of the crib mattress overlay 1200 from the crib sleeping surface 1203 in the crib 1201 in which crib mattress overlay 1200 is installed. The combination of the holes 1306 and the supports 1310 can provide improved airflow to a child laying on crib mattress overlay 1200. The offset achieved by the supports 1310 (shown in the form of pillars in FIG. 14) can allow air to pass between the bottom surface 1404 of the crib mattress overlay 1200 and the crib sleeping surface 1203, unlike other crib sleeping surfaces which preclude such substantial airflow as a result of the direct contact between adjacent layers in the sleeping surface assembly. The holes 1306 can provide a path by which the air between the bottom surface 1404 of crib mattress overlay 1200 and the crib sleeping surface 1203 can reach the top surface 1402 of the crib mattress overlay 1200.

This air circulation can advantageously provide ventilation to alleviate heat buildup between the top surface 1402 of the crib mattress overlay 1200 and a body of a child laying on the crib mattress overlay 1200. With such improved ventilation, crib mattress overlay 1200 may diminish the risk of pressure sores which can result from skin experiencing the combination of heat buildup and pressure. The improved air circulation provided by the combination of holes 1306 and supports 1310 can also provide a source of breathable air for a child if a child has flipped over onto its stomach during sleep. In some embodiments, the size and placement of the holes 1306 are selected to correspond to a baby's respiratory features (i.e., nose and mouth) so that regardless of the where the baby's head is on the top surface 1402 of crib mattress overlay 1200, the baby will still be able to breath through the crib mattress overlay 1200.

In various embodiments, crib mattress overlay 1200 has a cover 1250. In many embodiments, cover 1250 is removable. Cover 1250 can provide a uniform contour or unbroken face for top surface 1402. In some embodiments, cover 1250 can provide a medium for displaying an aesthetically desirable quality, such as an image, logo, or desired color. In various embodiments, cover 1250 is made of a breathable material so as to not substantially restrict the improved airflow provided by the combination of holes 1306 and supports 1310.

Figure 16:
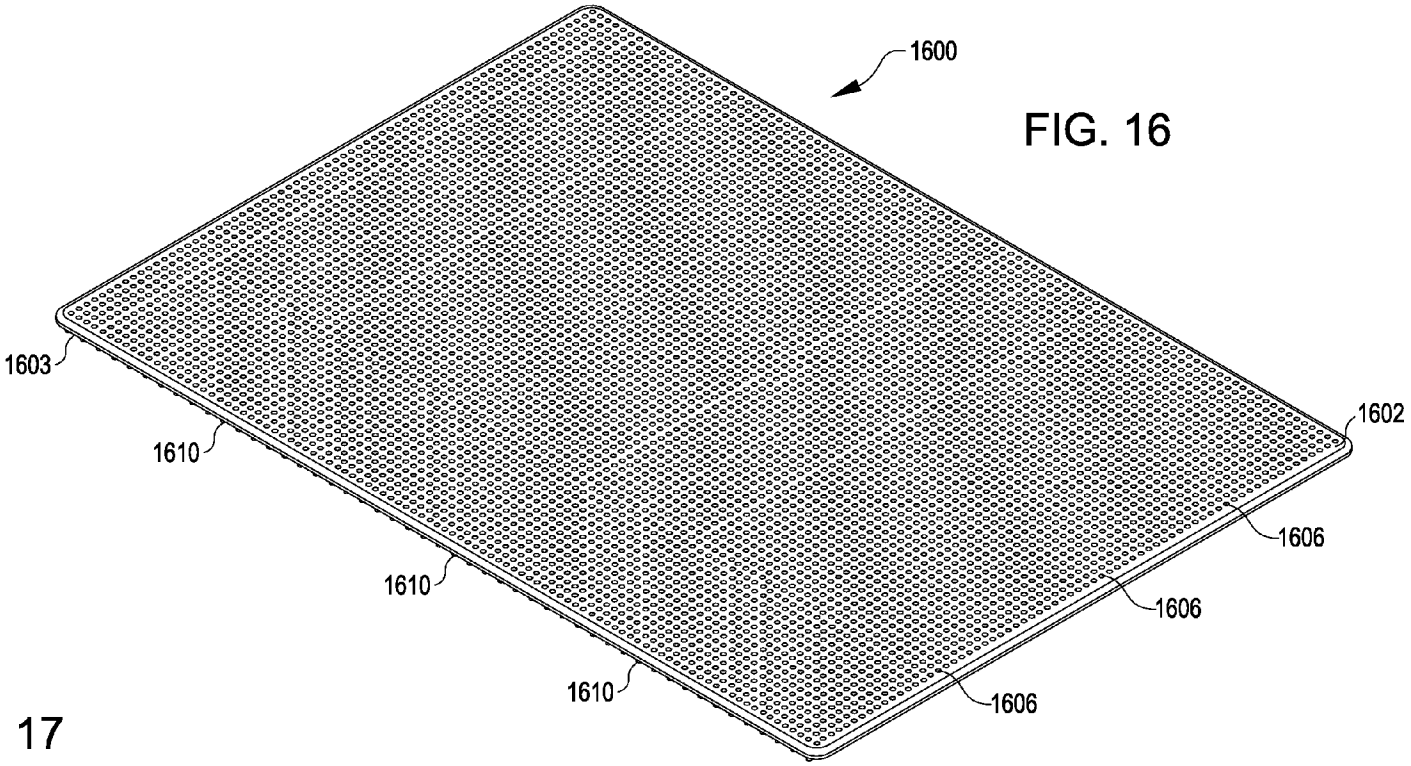
FIG. 16 is perspective view of a bed mattress overlay in accordance with various embodiments.

FIG. 16 shows a top perspective view of a bed mattress overlay 1600. As may be appreciated by comparing FIGS. 13 and 17, sleeping surface overlays such as crib mattress overlay 1200 and bed mattress overlay 1600 can be various sizes. Larger sizes may be provided for larger sleeping surfaces, and similarly, smaller sizes can be provided to match small size sleeping surfaces. Additionally, sleeping surface overlays may be configured to cover the entirety or less than the entirety of a sleeping surface. Furthermore, while discussion herein mainly references exemplary sleeping surfaces such as mattresses for cribs or beds, the overlay 1200/1600 can be used in conjunction with a wide variety of sleeping surfaces, including, but not limited to mattresses, floors, plywood, and substantially flat surfaces.

Figure 17:
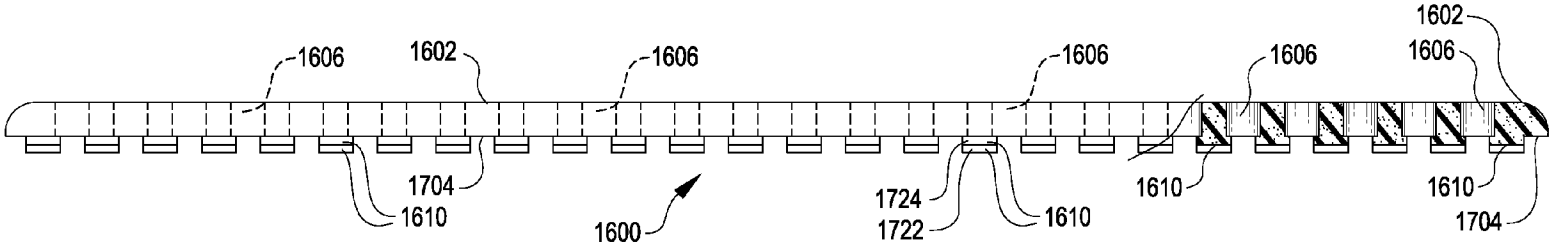
FIG. 17 is side-section view of a sleeping surface mattress overlay in accordance with various embodiments.
Figure 18:
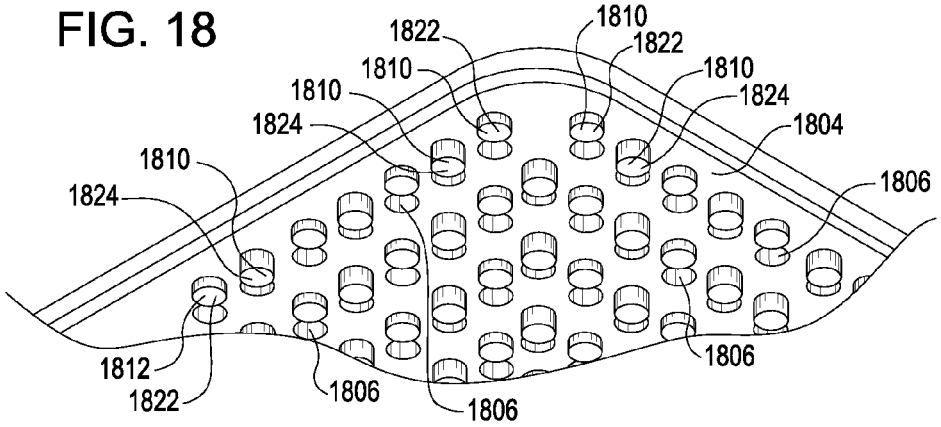
FIG. 18 is detail bottom perspective view of a sleeping surface mattress overlay in accordance with various embodiments.

As may be appreciated from a comparison of FIGS. 12-15 with FIGS. 16-18 bed mattress overlay 1600 and crib mattress overlay 1200 can have similar features (e.g., top surface 1602/1402, bottom surface 1704/1404, holes 1606/1306, supports 1610/1310, and cover 1250). Accordingly, bed mattress overlay 1600 can provide benefits in a bed context which crib overlay 1200 can provide in a crib context (e.g., ventilation, support, breathable air).

Figure 14:
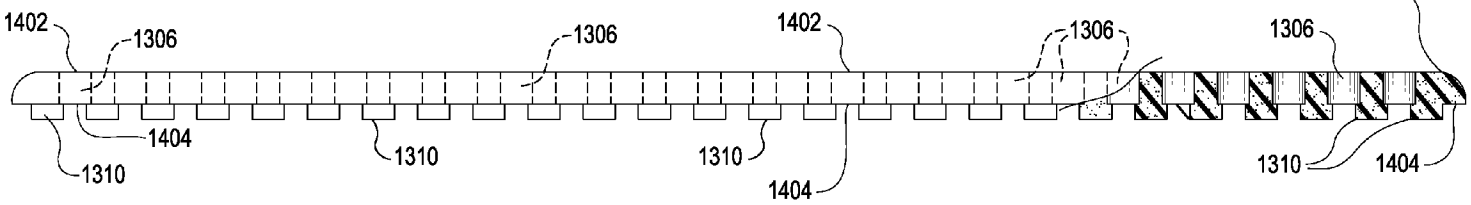
FIG. 14 a side-section view of a crib mattress overlay in accordance with various embodiments.
Figure 15:
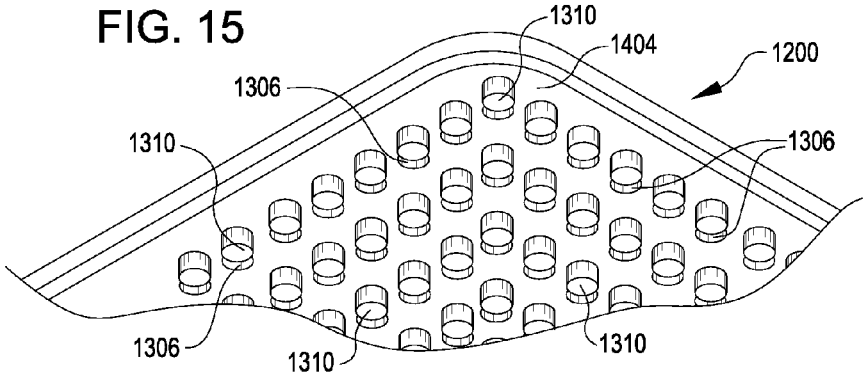
FIG. 15 is detail bottom perspective view of a crib mattress overlay in accordance with various embodiments.

As may be appreciated by comparing FIG. 14 with FIG. 17 and FIG. 15 with FIG. 18, in various embodiments, pillars 1310 can be of varying heights. In embodiments, some pillars (e.g., 1724) may vary in height from other pillars (e.g., 1722) in order to allow portions of the overlay 1200 to bend in response to load to conform to a user's body when disposed on the overlay. For example, the height of pillars 1310 may vary under portions of the overlay 1200 so as to provide additional pressure relief and/or comfort for particular regions in which pressure sores often develop, such as, but not limited to, a user's head, shoulders, hips, buttocks, and/or heels. In some embodiments, all pillars 1310 are of the same height. Although crib overlay 1200 is shown with supports 1310 all of a uniform height in FIGS. 14-15, in some embodiments, crib overlay has pillars with varying height. Similarly, although bed overlay 1600 is shown having some supports 1610 which vary in height in FIGS. 17-18, in various embodiments, bed overlay has pillars with uniform height as shown in FIGS. 14-15.

Additional benefits of the sleeping surface overlay 1600 can be appreciated given the possibility that in several contexts (such as in a hospital setting) the sleeping surface overlay 1600 may undergo substantial exposure to moisture such as perspiration, urination, or defecation. The holes 1606 in the sleeping surface overlay 1600 can allow moisture to pass through the sleeping surface overlay 1600, providing additional surface area for convection to work to evaporate the moisture. Additionally, in many embodiments the sleeping surface overlay 1600 is made with non-absorbent and completely washable material (for example, EVA foam, such as described above). Use of this material permits the sleeping surface overlays 1600 to be easily rinsed free of offending moisture, unlike some other sleeping surface overlays that tend to absorb the moisture in a material that is difficult to effectively clean. This ease of washing makes sleeping surface overlays 1600 particularly useful in healthcare contexts that utilize plastic covering to protect mattresses. An overlay 1600 can be placed on top of a bed mattress having a plastic covering. The overlay 1600 can provide additional ventilation to resolve heat dissipation issues of the plastic covering. Additionally, should a patient inadvertently defecate or urinate, the plastic will prevent damage to the mattress from drainage through the holes 1306/1606 in the overlay 1600, and the overlay 1600 can be washed instead of replaced.

Pet Crate Liner

In another adaptation, a pet crate liner is provided. While a such a liner will usually support a pet instead of a person, the adaptation is within the scope of the invention because a person may have an opportunity to stand on such a crate liner when interacting with a pet, and more importantly, such a crate liner would be capable of supporting at least a portion of a person's weight or a body part, regardless of whether the body part belongs to the person or the pet. Such a pet crate liner may be used in conjunction with a pet crate in order to provide a removable ground layer to the crate, which can provide advantages such as improved comfort for the pet and protection of the crate surface.

By way of introduction to the uninitiated, a well-established industry exists for pet crates. Pet crates can come in a variety of forms, but generally they provide an enclosure in which to keep a pet in instances when pets need to be confined for travel, security, sleeping, or other instances when adequate supervision is unavailable for the pet. A common practice is to include items in the crate which will make the crate seem more like a den for the pet or otherwise help the pet feel more comfortable in the crate.

However, several problems may occur with items placed in a pet crate. First, many animals have a tendency to chew on or eat items left in their immediate vicinity. As such, care must be taken either to avoid placing items in a pet crate that may be toxic if ingested or to constantly monitor the pet when in the crate with the item. Furthermore, frequently pets may defecate or urinate in the crate if left in the crate too long or if otherwise stressed or uncomfortable or unaccustomed to the crate. When this occurs, often the pet waste will ruin items in the crate, requiring unpleasant or difficult cleanup and costly replacement of the item.

In several embodiments of the present disclosure, a pet crate liner is provided with ventilation holes and supports which offset the bottom surface of the liner from the floor surface of the crate. The liner can provide several benefits, including, but not limited to, providing a comfortable surface for the pet while in the crate, providing a protective layer between the crate floor and the teeth or claws of the pet, and several other benefits as will become evident in the description of the pet crate liner that follows.

Figure 21:
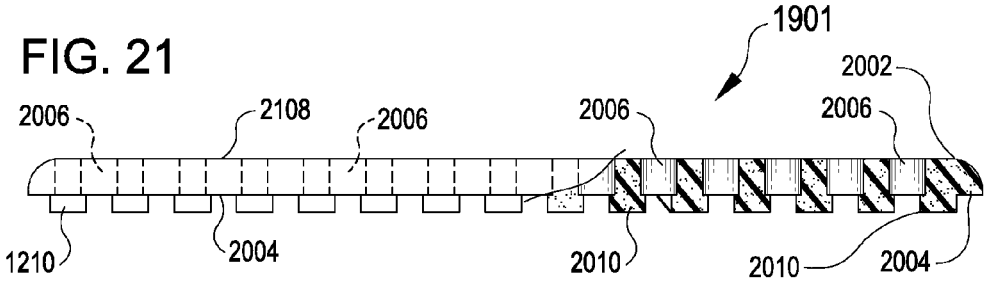
FIG. 21 is a side view of a pet crate liner in accordance with various embodiments.
Figure 22:
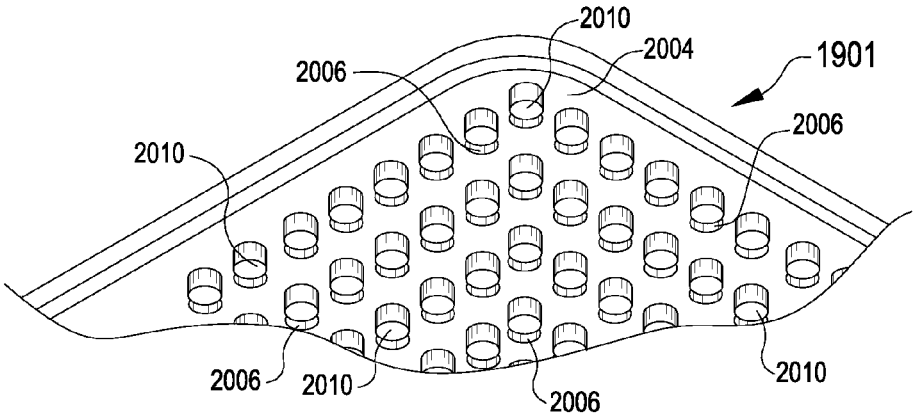
FIG. 22 is a bottom perspective view of a pet crate liner in accordance with various embodiments.

Referring now to the drawings, FIG. 19 shows a perspective exploded assembly view of a pet crate liner 1901 and a pet crate 1900 in accordance with various embodiments. As shown in FIGS. 20-22, pet crate liner 1901 can have a plurality of holes or ports 2006, each of which passes through top surface 2002 of pet crate liner 1901 and through bottom surface 2004. A plurality of supports 2010 can provide the support necessary to offset the bottom surface 2004 of the pet crate liner 1901 from the floor surface 1903 of the pet crate 1900 in which the pet crate liner 1901 is installed. The combination of the holes 2006 and the supports 2010 can provide improved airflow between the liner 1901 and the crate floor 1903. The offset achieved by the pillars 2010 can allow air to pass between the bottom surface 2004 of pet crate liner 1901 and the crate floor 1903, unlike other crate liners which preclude such substantial airflow as a result of the direct contact between the liner and the crate floor. Thus, the holes 2006 can provide a path by which the air between the bottom surface 2004 of pet crate liner 1901 and the crate floor 1903 can directly reach the pet, providing ventilation in situations when necessary. Alternatively, the crate liner 1901 can be covered with a fabric sheath (not shown) in situations where less ventilation is desired. The fabric sheath can cover all of the holes 2006 or less than all of the holes. The sheath can also be breathable.

A further benefit of pet crate liner 1901 is that it can be fabricated from non-toxic material. Thus, if a pet chews on the pet crate liner 1901 or swallows it, the pet will not be harmed. In many embodiments, non-toxic EVA foam is used to make pet crate liner 1901 to provide this feature.

Additional benefits of the pet crate liner 1901 can be appreciated when the liner 1901 is installed in a crate 1900 in which a pet urinates or defecates. The holes 2006 in the liner 1901 can allow urine to pass through the liner 1901, while the supports 2010 can provide space for the urine to go into between the bottom surface 2004 of the liner 1901 and the crate floor 1903. The supports 2010 can thus help elevate the pet above pooled urine, potentially avoiding a situation common with other crate liners in which, after the animal urinates in the crate, the urine gets all over the animal, and the animal must be bathed as part of the already tedious process of cleaning up after the animal's incident. Additionally, in many embodiments the crate liner 1901 is made with non-absorbent and completely washable material (for example, EVA foam, such as described above). Use of this material can further facilitate cleanup and eliminate costly replacement since the crate liner 1901 can easily be washed before reuse, unlike other crate liners which may absorb the urine or defecation and be ruined, requiring immediate disposal and replacement.

Bicycle Seat Cover Cushion

In another adaptation, a bicycle seat cover cushion is provided. Such a cover may be used with any kind of bicycle seat, including, but not limited to, racing bicycle seats and cruiser bicycle seats.

By way of introduction to the uninitiated, bicycle seats come in a variety of shapes and sizes, corresponding to the wide variability in individual body types and kinds of anticipated activity. For example, seat style may differ according to whether the seat is likely to be used on a bicycle in a racing context or on a bicycle utilized for a leisurely ride. With the wide variety of seat styles, numerous designs exist to improve the comfort of a seat while riding a bicycle. However, effective new methods to improve support and comfort provided by bicycle seats are persistently desired. As in other cushion design, key comfort considerations may include how well a seat will match the anatomy of the user, how much ventilation the seat provides, the level of deflection of the seat material when loaded, and the durability of the seat material, which often affects how often a seat will need to be replaced.

Figure 23:
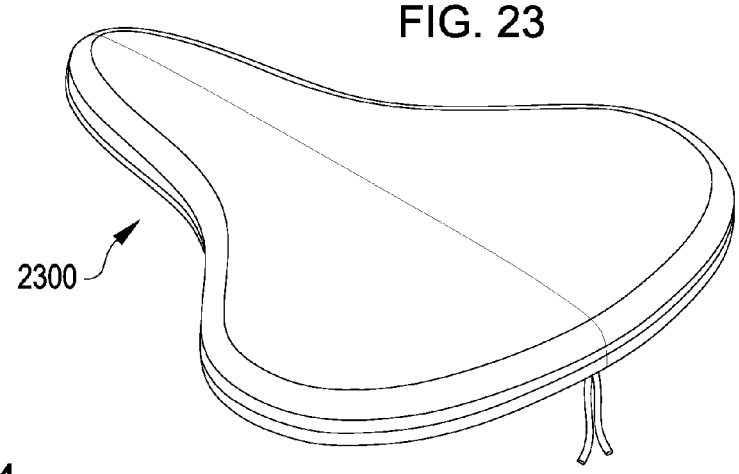
FIG. 23 is a top view of a cruiser bicycle seat cover in accordance with various embodiments.
Figure 25:
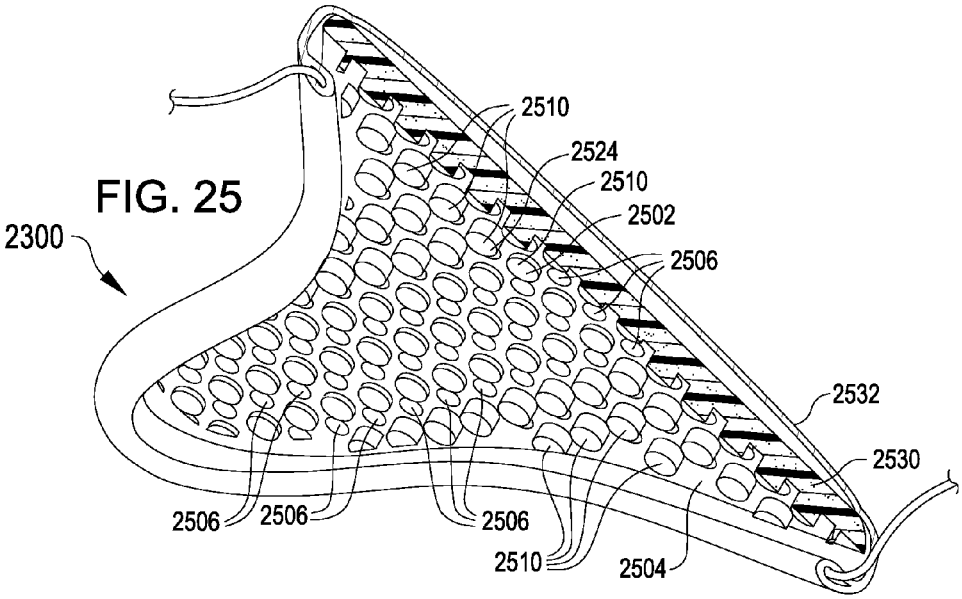
FIG. 25 is a bottom perspective cutaway view of a cruiser bicycle seat cover in accordance with various embodiments.

In several embodiments of the present disclosure, a bicycle seat cover cushion is provided with ventilation holes and supports which offset the bottom surface of the seat cover cushion from the topmost or skin surface of the bicycle seat. Referring again to the drawings, FIG. 23 shows a top view of a cruiser bicycle seat cover 2300 in accordance with various embodiments. As shown in FIG. 25, in many embodiments, the seat cover cushion 2300 comprises both a cushion core 2530 and a casing 2532. Cruiser seat cover cushion core 2530 can have a plurality of holes or ports 2506, each of which passes through a top surface 2602 (shown e.g., in FIG. 26) of the core 2530 and through a bottom surface 2504 of the core 2530. As also shown in FIG. 25, a plurality of supports 2510 can provide the support necessary to offset the bottom surface 2504 of the seat cover cushion 2300 from the skin surface 2603 of the bicycle seat 2601 (shown e.g., in FIG. 26) upon which the seat cover cushion 2300 is installed. The combination of the holes 2506 and the supports 2510 can allow improved airflow to the rider at the interface between the rider's body and the skin surface 2603 of the bicycle seat 2601 when the seat cover cushion 2300 is installed. The offset achieved by the supports 2510 (shown in the form of pillars in FIG. 25) can allow air to pass between the bottom surface 2504 of the cushion core 2530 and the skin surface 2603 of the bicycle seat 2601, unlike other seat covers which preclude such substantial airflow as a result of the gapless contact between the rider's body and the skin surface 2603 of the bicycle seat 2601. Furthermore, the holes 2506 can provide a path by which the air between the bottom surface 2504 of the seat cushion cover 2300 and the skin surface 2603 of the bicycle seat 2601 can reach the top surface 2602 of the seat cover cushion core 2530 to provide improved ventilation to the rider's body.

In various embodiments, the casing 2532 permits passage of the airflow that is available as a result of the interaction of the supports 2510 and the holes 2506. In many embodiments, as shown in FIG. 23, the casing 2532 is made of a breathable material so that the holes 2506 are obscured through the casing 2532, but air flow through the holes 2506 is not seriously hampered. In some embodiments (not shown), the casing 2532 is made of a porous material through which the holes 2506 can be seen and through which air can flow.

Figure 26:
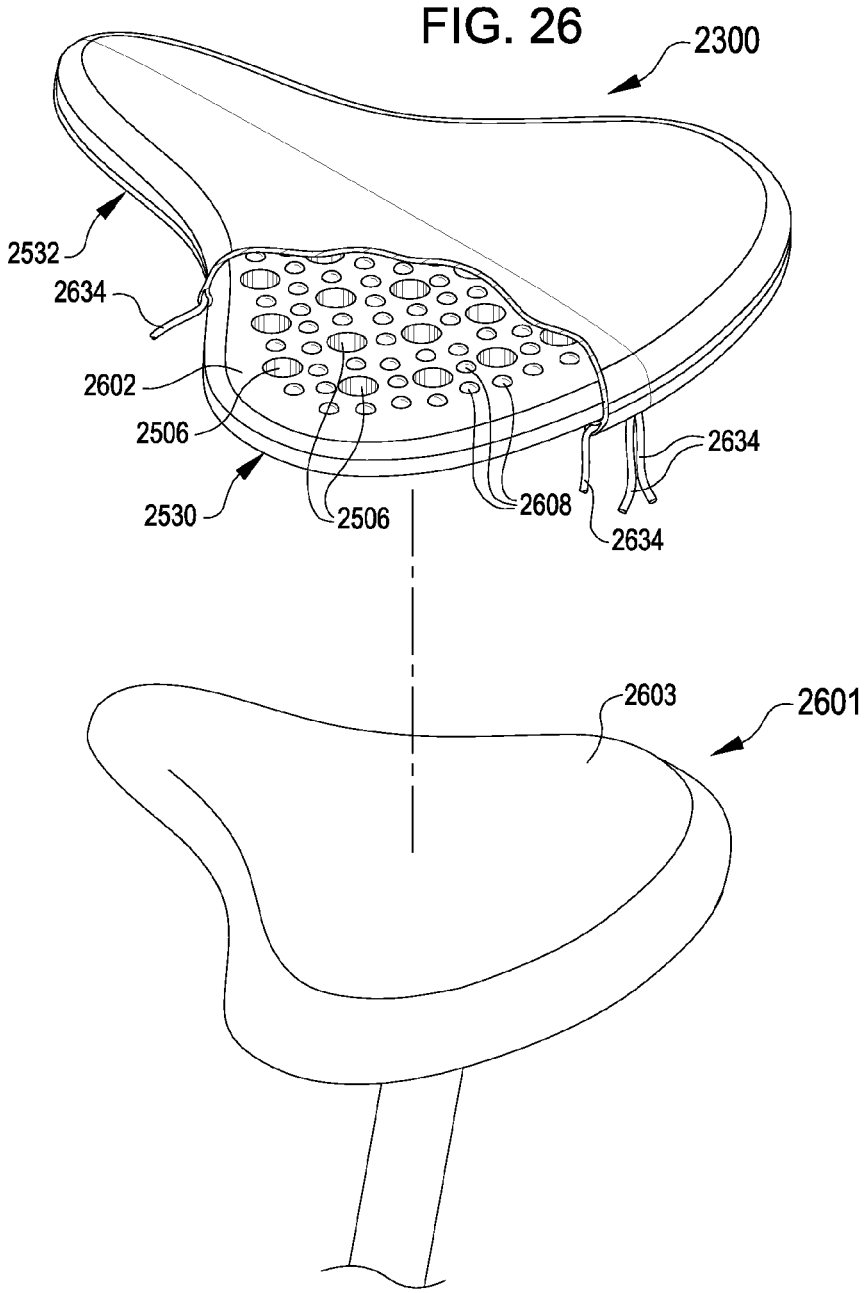
FIG. 26 is a perspective view of a cruiser bicycle seat cover before installation on the bicycle seat in accordance with various embodiments.
Figure 27:
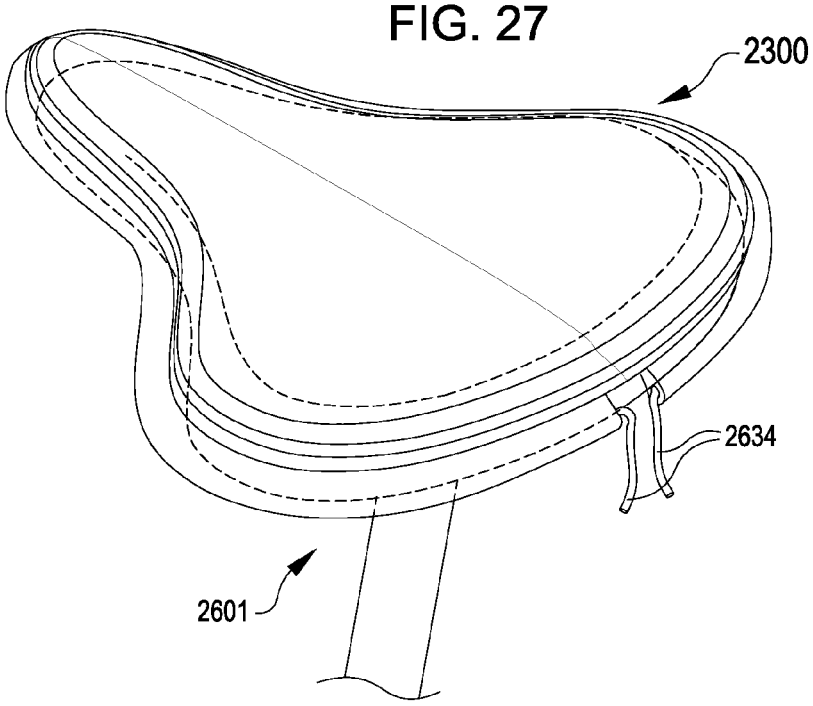
FIG. 27 is a perspective view of a cruiser bicycle seat cover during installation on the bicycle seat in accordance with various embodiments.
Figure 28:
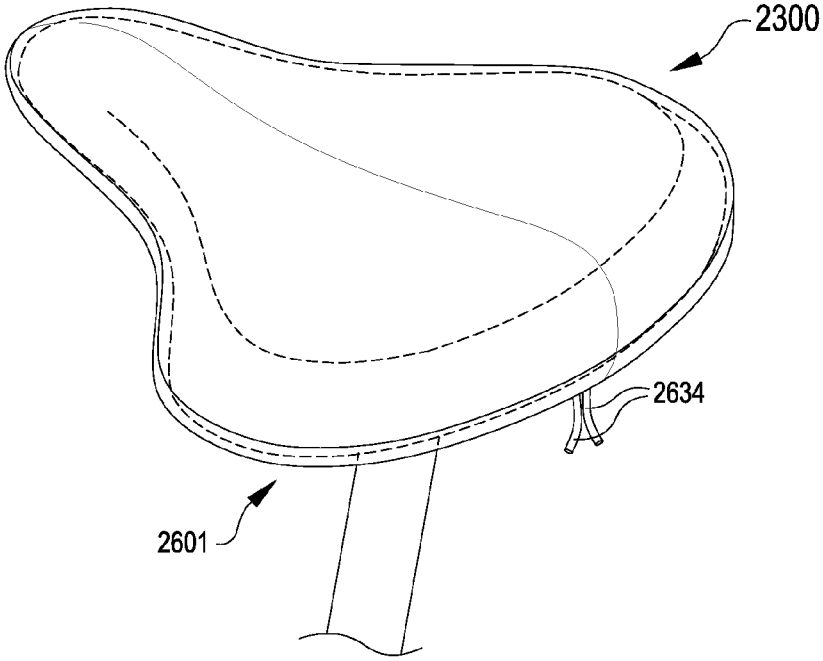
FIG. 28 is a perspective view of a cruiser bicycle seat cover after installation on the bicycle seat in accordance with various embodiments.

As shown in FIG. 26-28, in many embodiments, the casing 2532 can be utilized to secure the seat cover cushion 2300 to the bicycle seat 2601. In some embodiments, the casing 2532 has a cinch cord 2634 for constraining the seat cover cushion 2300 to the bicycle seat 2601. In various embodiments, the casing 2532 may be flared out and placed over a bicycle seat 2601 as shown in FIGS. 26-27, and then drawn back in to complete installation as shown in FIG. 28. In various embodiments, the drawing is achieved by pulling a cinch cord 2634. However, any means of securing the seat cover cushion 2300 to the bicycle seat 2601 can be employed, including, but not limited to hook & loop fasteners, straps, tie downs, snaps, buttons, and fasteners.

As shown in FIG. 26, in various embodiments, the seat cover cushion 2300 has a plurality of nubs 2608 interspaced among the holes 2506. These nubs 2608 can provide a desirable additional tactile characteristic to the seat cover cushion 2300 and are thought to stimulate nerve activity and improved blood circulation in the portion of a person's body placed in contact with them. In some embodiments, the nubs 2608 may be included to further improve ventilation of a cushion core 2530 with a casing 2532. For example, when a user is not putting weight on the seat cover cushion 2300 (such as when riding in a position standing on the bicycle pedals instead of sitting on the seat) the nubs 2608 may provide sufficient separation between the casing 2532 and the cushion core 2530 so as to provide airflow there between to allow more rapid cooling or drying of the parts of the seat cover cushion due to increased airflow and convection.

As shown in FIG. 25, in many embodiments, pillars 2510 can be of varying heights. For example, some pillars (e.g. 2524) may vary in height from other pillars (e.g. 2522) in order to allow portions of the seat cover cushion 2300 to bend in response to load to conform to a rider's body as the rider places or shifts weight on the seat cover cushion 2300. This allows the seat cover cushion 2300 to have a dynamic response in which it bends and flexes according to the bicycle rider's weight to more evenly (when compared to just immersion or a fixed contour) redistribute pressure applied by the seat 2601 to the rider's body. As the seat cover cushion 2300 changes shape in conforming to the load and contour of the individual user, pressure is distributed away from areas of high pressure and to areas of lower pressure, thereby improving comfort and reducing the occurrence of the pressure concentration points that can cause the areas of soreness frequently associated with prolonged time on a bicycle seat. This improved dynamic pressure distribution from bending and flexing is particularly useful in the bicycle seat context because bicycle riding entails frequent readjustments of weight, whether from switching between riding sitting down and standing up, or whether from responding to bumps or elevation changes involved in the route, or whether from the minor shifts of weight necessary for a rider to maintain his balance while riding. In various embodiments, the pattern of pillars 2510 with differing heights is configured to focus the dynamic response in areas known to carry the most load or to exert the most pressure. For example, in various embodiments, the pillars which vary in height are grouped in areas of the seat cover cushion 2300 where the ischials of a user are most likely to contact the seat cover cushion 2300. In various embodiments, pillars which vary in height are grouped in an area of the seat cover cushion where the coccyx of a user is most likely to contact the seat cover cushion 2300.

Figure 24:
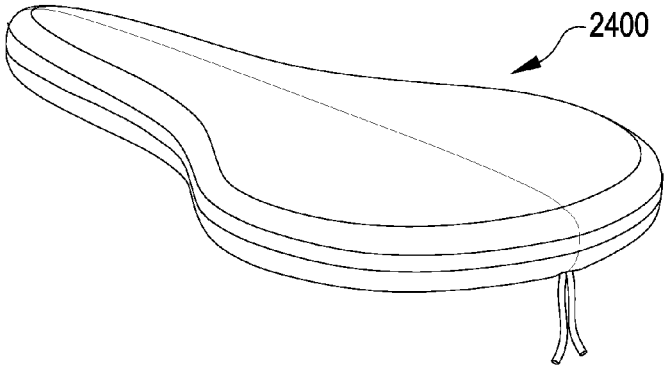
FIG. 24 is a top view of a racer bicycle seat cover in accordance with various embodiments.

As shown in FIG. 24, in various embodiments, a seat cover cushion 2400 is provided with a slimmed shape to conform to racing bicycle seats rather than cruising bicycle seats. In many embodiments, a seat cover cushion 2400 can be provided having pillars 2510 all of uniform height. In embodiments, the seat cover cushion 2400 can also include features described above in reference to the seat cover cushion 2300, including, but not limited to, holes 2506, cushion core 2530, casing 2532, cinch cord 2634, and nubs 2608.

Additional benefits of the bicycle seat cover cushion 2400 can be appreciated given the high likelihood that the bicycle seat cover cushion 2400 will undergo substantial exposure to perspiration. The holes 2506 in the bicycle seat cover cushion 2400 can allow sweat to pass through the bicycle seat cover cushion 2400, providing additional surface area for convection to work to evaporate the perspiration. Additionally, in many embodiments the bicycle seat cover cushion 2300 is made with non-absorbent and completely washable material (for example, EVA foam, such as described above). Use of this material permits the bicycle seat cover cushion 2400 to be easily rinsed free of perspiration, unlike some other bicycle seats or covers that tend to absorb the perspiration in a material that is difficult to effectively clean.

Yoga Mat

In another adaptation, a yoga mat is provided. In several embodiments, a yoga mat is provided with ventilation holes and supports which offset the bottom surface of the yoga mat from the ground upon which it is placed.

By way of introduction to the uninitiated, yoga mats are thin pads commonly used for activities—such as yoga—in which a person has frequent interaction with the ground, such as when in a prone position or when pushing against the ground to achieve a certain contortion, stretch, or movement of a body part. Primary functions of yoga mats are to provide a cushion to alleviate discomfort from pressure at the place of body-ground interaction, and to provide a surface which will improve safety by minimizing the slipping of skin or clothing during such interaction. Frequently, yoga mats are designed to be rolled up or otherwise compacted for storage and transport.

Figure 29:
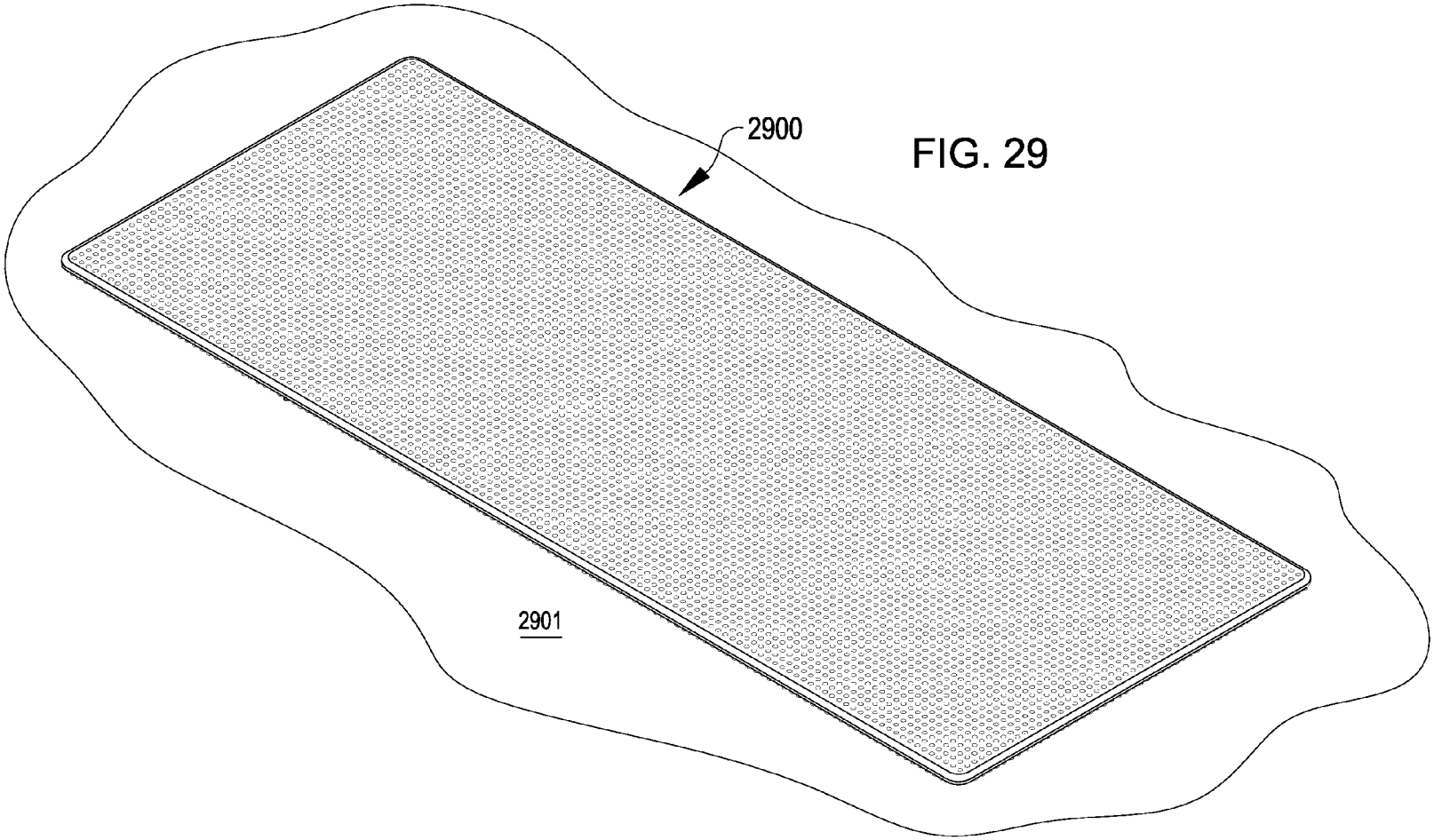
FIG. 29 is top perspective view of a yoga mat in accordance with various embodiments.
Figure 30:
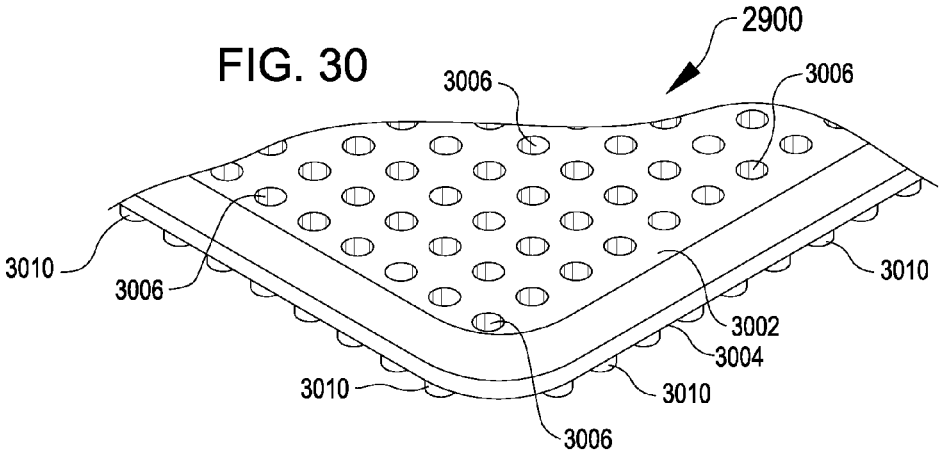
FIG. 30 is a detail top perspective view of a yoga mat in accordance with various embodiments.
Figure 31:
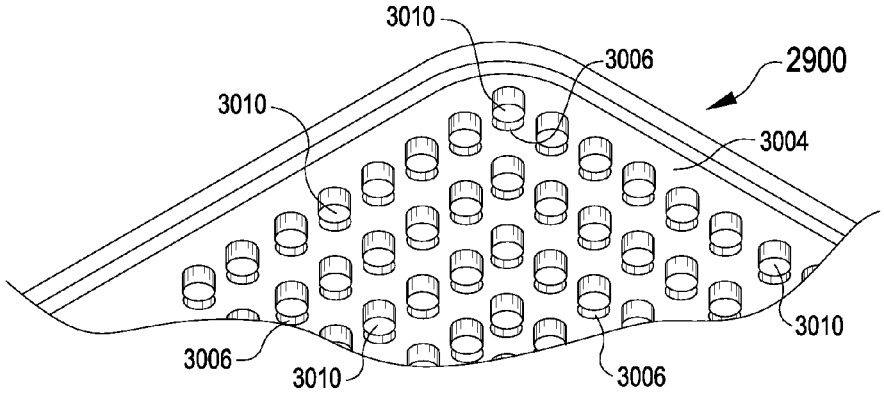
FIG. 31 is detail bottom perspective view of a yoga mat in accordance with various embodiments.
Figure 32:
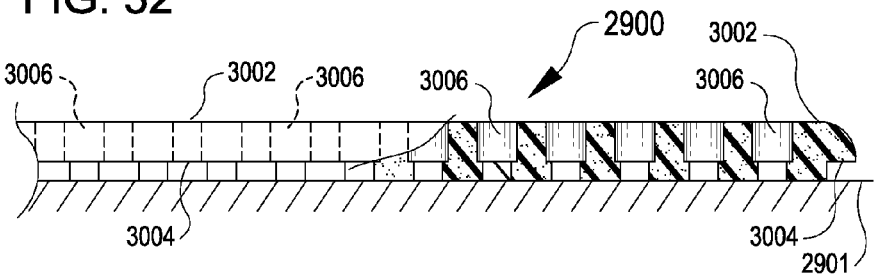
FIG. 32 is detail side view of a yoga mat in accordance with various embodiments.

However, current yoga mats have a number of drawbacks, most notably ventilation. Because yoga mats are often used for activities involving significant physical exertion, it is quite common for a person to perspire profusely when using a yoga mat. Sweat can thus accumulate on the mat, making the mat not only unpleasantly slimy, but also potentially dangerously slippery Referring now to the drawings, FIG. 29 shows a top perspective view of a yoga mat 2900 placed on the ground surface 2901 in accordance with various embodiments of the present disclosure. As shown in FIGS. 30-31, yoga mat 2900 can have a plurality of holes or ports 3006, each of which passes through top surface 3002 of yoga mat 2900 and through bottom surface 3004. A plurality of supports 3010 can provide the support necessary to offset the bottom surface 3004 of the yoga mat 2900 from ground surface 2901 on which yoga mat 2900 is used. The combination of the holes 3006 and the supports 3010 can provide improved airflow to a person using or supported by yoga mat 2900. The offset achieved by the supports 3010 (shown in the form of pillars in FIG. 31) can allow air to pass between the bottom surface 3004 of the yoga mat 2900 and ground surface 2901, unlike other yoga mats which preclude such substantial airflow as a result of the direct contact between the bottom of such yoga mats and the ground. The holes 3006 can provide a path by which the air between the bottom surface 3004 of 2900 and the ground surface 2901 can reach the top surface 3002 of the yoga mat 2900.

This air circulation can advantageously provide ventilation to alleviate heat buildup between the top surface 3002 of the yoga mat 2900 and a body of a user of yoga mat 2900. With such improved ventilation, yoga mat 2900 may help cool the body of a user and reduce perspiration that can lead to the unwanted slipperiness of the yoga mat. Even if a user perspires extensively on yoga mat 2900, the added ventilation provided by yoga mat 2900 may help speed evaporation of this perspiration, reducing the risk of slipperiness.

In various embodiments, yoga mat 2900 can be rolled up or otherwise compacted for storage or transportation. In various embodiments, holes 3006 and supports 3010 are sized and configured so as to minimize the diameter of yoga mat 2900 when it is rolled up. In embodiments, the height of supports 3010 is less than the thickness between top surface 3002 and bottom surface 3004 of yoga mat 2900. In embodiments, the height of supports 3010 is less than half the thickness between top surface 3002 and bottom surface 3004 of yoga mat 2900. In embodiments, the customary size of fingers of users likely to use the yoga mat 2900 is a factor in determining the size of the holes 3006.

Additional benefits of the yoga mat 2900 can be appreciated given the high likelihood that the yoga mat 2900 will undergo substantial exposure to perspiration. The holes 3006 in the yoga mat 2900 can allow sweat to pass through the yoga mat 2900, providing additional surface area for convection to work to evaporate the perspiration. Additionally, in many embodiments the yoga mat 2900 is made with non-absorbent and completely washable material (for example, EVA foam, such as described above). Use of this material permits the yoga mat 2900 to be easily rinsed free of perspiration, unlike some other yoga mats that tend to absorb the perspiration in a material that is difficult to effectively clean.

Helmet Liner

In another adaptation, a cushion liner for a helmet is provided. Such a liner may be incorporated into a helmet to provide the helmet with improved airflow, improved support, and improved impact response. Such a liner can be used in a variety of different helmets, including, but not limited to, bicycle helmets and football helmets.

By way of introduction to the uninitiated, helmets are apparel worn on the head to provide protection from injuries due to blows to the head. Helmets are very commonly worn as a safety precaution by participants in high-impact or high-speed sports. In such cases, a helmet can provide a layer to reduce the shock, impact, or pressure of blows resulting from collisions at high speed or force, thus diminishing the intensity of the blow and reducing the severity of any consequential injury.

A wide variety of helmet styles exists, and often helmet style will depend on the specific activity pursued. For example, to name but a few, helmet styles include football helmets, bicycle helmets, motorcycle helmets, military helmets, rock-climbing helmets, rafting helmets, kayaking helmets, skateboard helmets, and ski helmets. While each of these helmets generally has features specially tailored to its probable use, comfort of wearing the helmet is a common consideration regardless of helmet style. Protection from blows is a similarly universal helmet consideration regardless of helmet type. In addition, since many helmets fit very closely to the head, resulting heat buildup and ventilation issues frequently arise.

Figure 33:
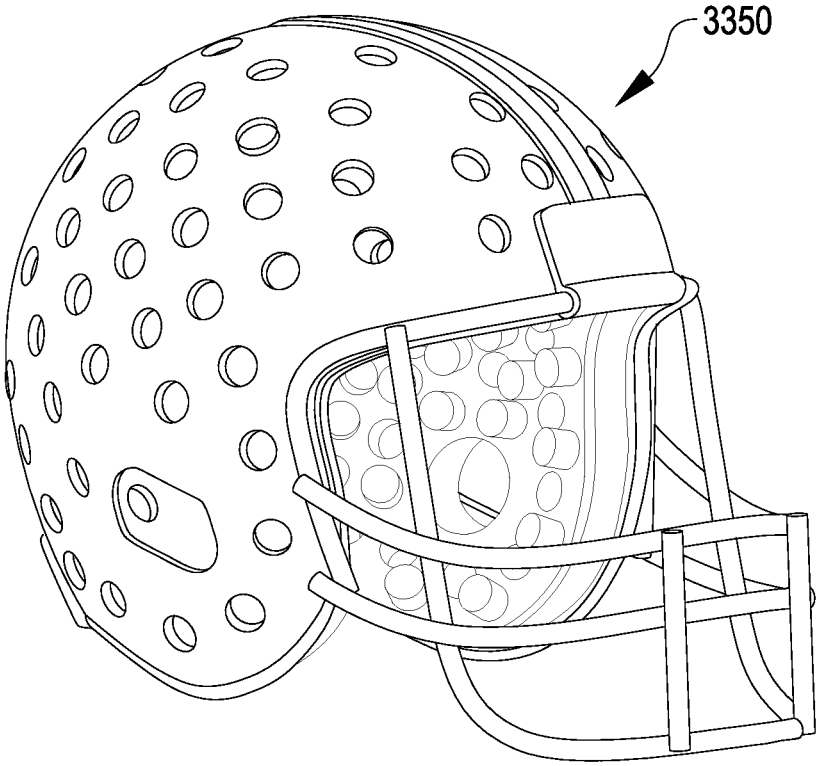
FIG. 33 is a perspective view of an assembled helmet in accordance with various embodiments.
Figure 34:
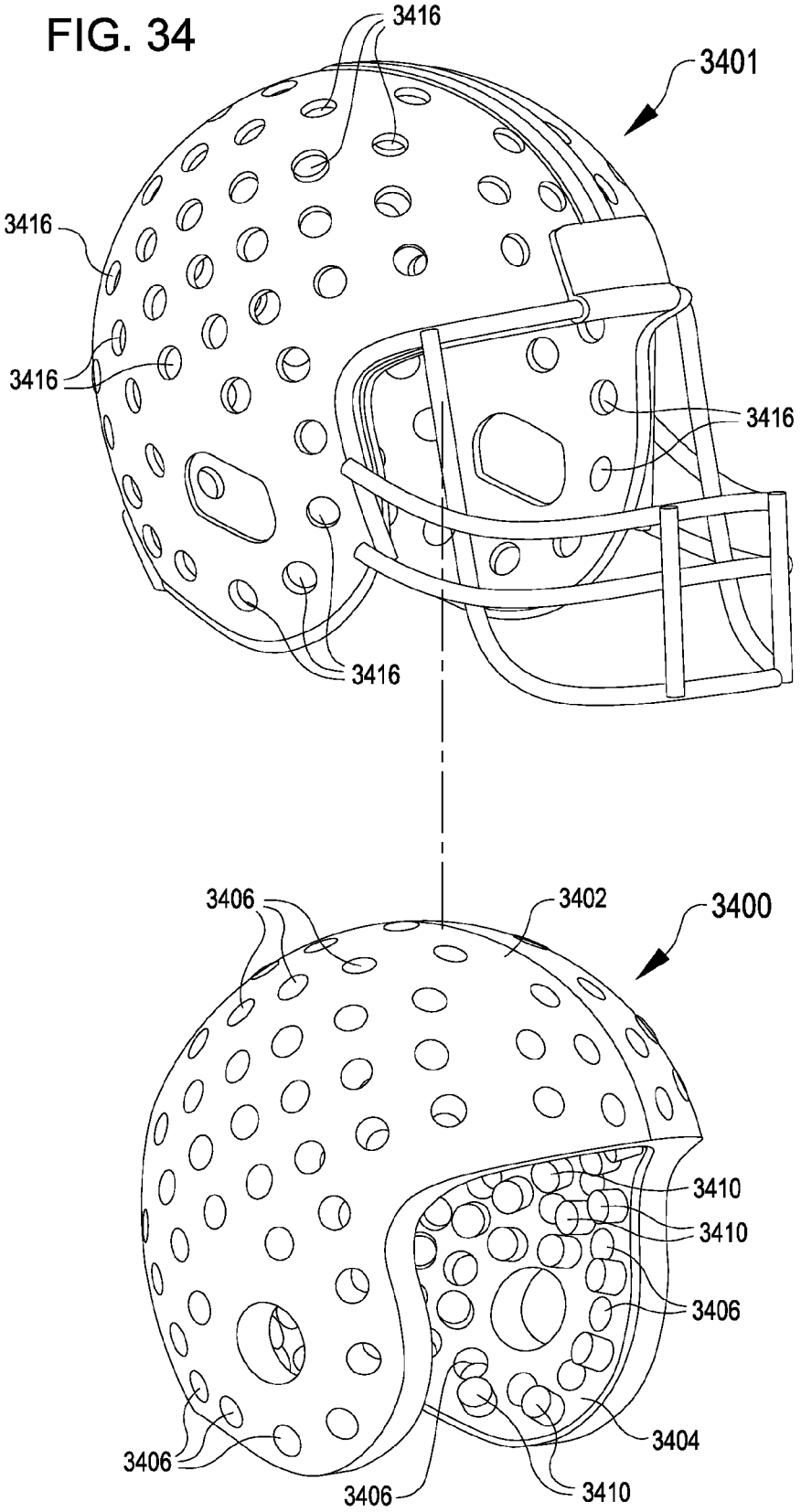
FIG. 34 is an exploded perspective view of a helmet assembly showing a shell and a liner in accordance with various embodiments.

In several embodiments of the present disclosure, a helmet liner is provided with supports which offset an inner surface of the helmet liner from the head upon which the liner is placed. Referring now to the drawings, FIG. 33 shows a perspective view of an assembled helmet 3350. As shown in FIG. 34, the helmet 3350 can have a helmet shell 3401 and a helmet liner 3400 in accordance with various embodiments. A plurality of supports 3410 can provide the support necessary to offset the interior surface 3404 of the liner 3400 from the head of a wearer of the helmet 3350 having the liner 3400. The offset achieved by the supports 3410 (shown in the form of pillars in FIG. 34) can allow air to pass between the interior surface 3404 of the helmet liner 3400 and the head of the wearer, unlike other helmets or liners which preclude such substantial airflow as a result of the direct contact between the head of a wearer and the interior surface of the helmets or liners.

In embodiments, the liner 3400 can have a plurality of holes or ports 3406, each of which passes through an exterior surface 3402 of the liner 3400 and through an interior surface 3404 of the liner 3400. The holes 3406 can provide a path by which the air between the wearer's head and the interior surface 3404 can vent through to the exterior surface 3402 of the liner 3400. In various embodiments, the combination of the holes 3406 and the supports 3410 can provide improved airflow to the head of a person wearing the liner 3400.

As also shown in FIG. 34, in various embodiments, the shell 3401 contains a plurality of holes 3416. In many embodiments, when the liner 3400 is assembled with the shell 3401, a sufficient number of shell holes 3416 align with liner holes 3406 so as to allow air to circulate between the inside of the helmet and the outside of the helmet through holes 3406 and 3416. This configuration can advantageously provide ventilation to the wearer's head when the wearer is wearing the helmet, especially during activity that is likely to make the wearer perspire. In some embodiments, the interaction between the pillars 3410 and the ports 3406 and 3416 are believed to provide improved shock or impact response characteristics.

Figure 35:
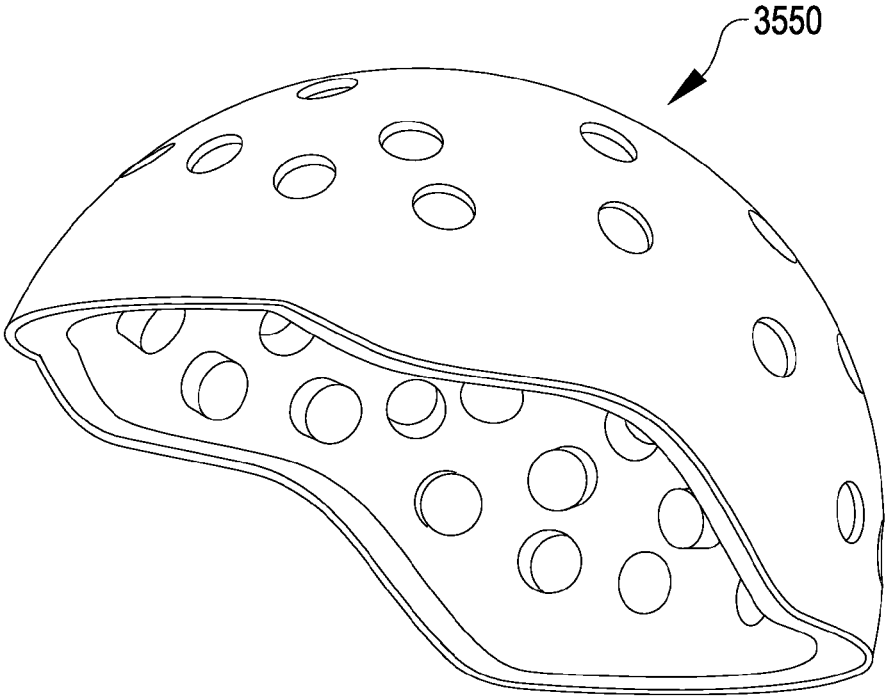
FIG. 35 is a perspective view of another assembled helmet in accordance with various embodiments.
Figure 36:
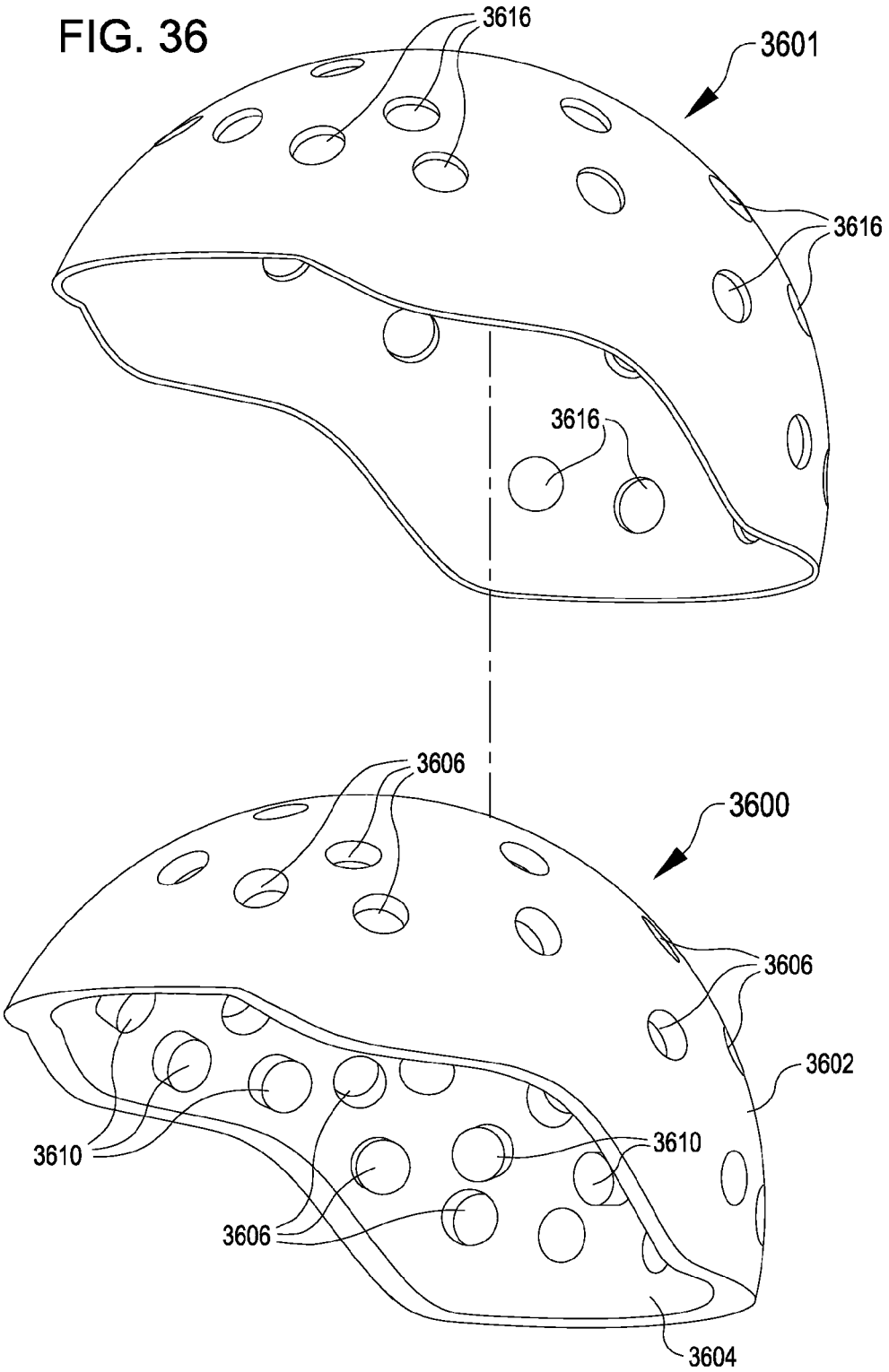
FIG. 36 is an exploded perspective view of another helmet assembly showing a shell and a liner in accordance with various embodiments.

FIGS. 35 and 36 show another embodiment of a helmet 3500 with a shell 3601 and a liner 3600. As may be appreciated from a comparison of FIGS. 35 and 9 with FIGS. 6 and 7, embodiments may include a wide variety of helmets having varied sizes and shapes, and are not limited to the football helmet of FIGS. 33-34 or the bicycle helmet of FIGS. 35-36. In addition, embodiments can include any amount or pattern of distribution of supports 3610, holes 3406, and holes 3416. Liner 3600 may be configured so that the inner surface 3604 and outer surface 3602 cover as much or as little of a wearer's head as desired in a given context. In various embodiments, the liner 3600 is also made with non-absorbent, washable material, providing a liner that is easy to clean and that will not be ruined by persistent exposure to perspiration.

Figure 37:
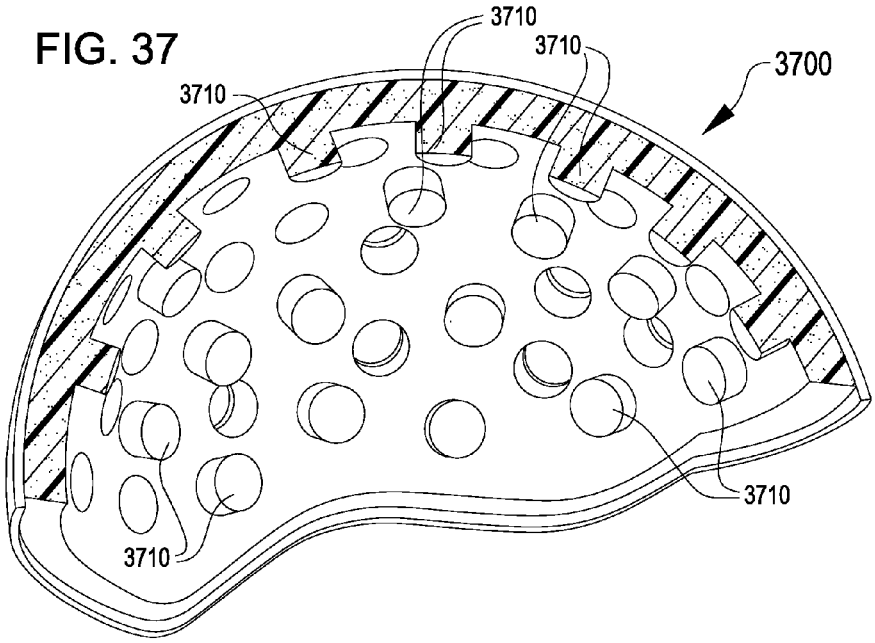
FIG. 37 is section view of a helmet and liner assembly in accordance with various embodiments.
Figure 38:
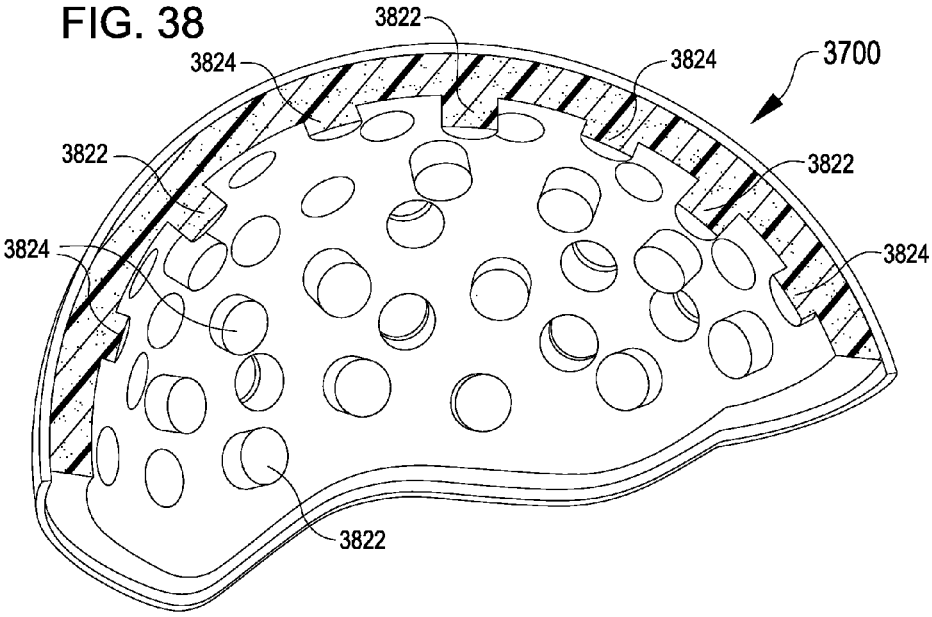
FIG. 38 is section view of another helmet and liner assembly in accordance with various embodiments.

FIGS. 37-38 show section views of helmet and liner assemblies in accordance with various embodiments. As shown in FIG. 37, in many embodiments, supports 3710 are of a uniform height. However, as may be appreciated by comparing FIG. 37 with FIG. 38, in various embodiments, supports 3710 can be of varying heights. In embodiments, some pillars (e.g. 3824) may vary in height from other pillars (e.g. 3822) in order to allow portions of the liner 3700 to bend in response to load to better conform to the head of a wearer and/or better react to impact, shock, or pressure.

Figure 42:
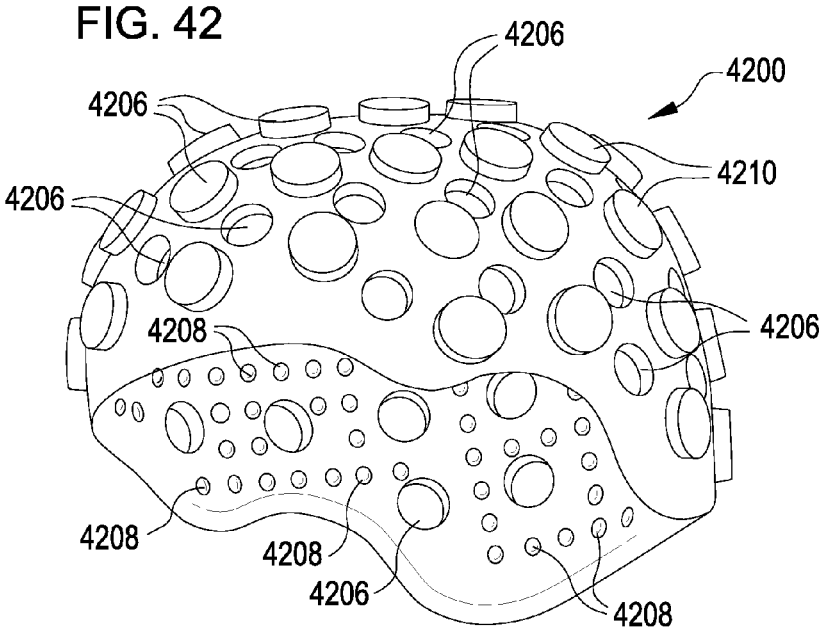
FIG. 42 is a perspective view of a helmet liner having an alternate arrangement of supports and ports in accordance with various embodiments.

Other adaptations of helmet liner are also possible. For example, FIG. 42 is a perspective view of a helmet liner 5200 having an alternate arrangement of supports 4210 and ports 4206 in accordance with various embodiments. As may be appreciated in a comparison of FIG. 34 with FIG. 42, in various embodiments, supports 4210 may additionally or alternatively be arranged on an exterior of the helmet liner 4200. For example, whereas the helmet liner 3400 depicted in FIG. 34 does not include any supports 3410 arranged between the exterior surface 3402 of the liner 3400 and the interior surface of the helmet shell 3401, the helmet liner 4200 depicted in FIG. 42 has a plurality of supports 4210 arranged on an exterior surface of the liner 4200 that may interface with an interior surface of a helmet shell upon installation into the helmet shell. Providing the plurality of supports 4210 on an exterior of the helmet liner 4200 can provide spacing and support to offset an exterior surface of the helmet liner 4200 from an interior surface of a helmet shell, such as for improved ventilation through the ports 4206 and/or shock absorption qualities. Although not shown in the figures, in some embodiments, a helmet liner may include a plurality of supports on both interior and exterior surfaces of the helmet liner. In some aspects, a plurality of nubs 4208 may be provided in addition to or in place of some or all of a plurality of supports 4210 and/or 3410. The nubs 4208 may have similar characteristics and/or functions as the nubs 608 described with reference to FIG. 8 above.

Foot Positioner

In another adaptation, a foot positioner cushion is provided. Such a foot positioner can be utilized to support the feet of an individual in seated, reclined, and/or supine positions to provide additional support and improved ventilation to the feet of an individual.

By way of introduction to the uninitiated, individuals who are confined to a bed for extended periods of time (such as the elderly and others that may be recovering from injury or illness) are often at high risk for developing the decubitus ulcers ("pressure sores") previously referenced herein. While the term "pressure sores" may lead one to believe that pressure is the sole cause, progressing research indicates that shear (lateral deflection of tissue) is a major contributing factor. A discussion and citation of such research regarding shear can be found in SHEAR, A Contributory Factor in Pressure Ulceration, by Shear Force Initiative, http://shearforceinitiative.com, the entire disclosure of which is hereby incorporated herein by reference, in addition to the entire disclosure of all references cited therein. Coupled with pressure, shear force on the soft tissue is a significant factor in the development of pressure sores.

Several general anatomical areas can be problematic for patients that develop presure sores and the health care professionals and hospitals that work with them. For example, anatomical areas commonly considered high risk for pressure sores include the back of the head, shoulder blades, sacrum and pelvis, and the heels. Some progressing research has focused in particular on pressure sores at the heels. One example of such research is Wounds International, Vol. 4, eSupplement, by Wounds International, 2013, ISSN 2044-0057, www.woundsintemational.com, the entire disclosure of which is hereby incorporated herein by reference, in addition to the entire disclosure of all references cited therein. The article indicates that pressure sore incidence rates are about 18% in people that are laying in bed for prolonged time during the day. While such rates are less than previous estimates, the rates were derived from a sample of 104,000 patients in which pressure sores were counted only on the heel and not on other parts of the ankle.

To address such pressure sores on the heel, most facilities in the US and worldwide use foam boots of one type or another for pressure sore prevention and to isolate pressure away from the heel. Many of these boots just wrap around the foot and lower leg with some support to help prevent high pressure at the heel. The boots are cumbersome, time consuming to put on and take off, and often make walking difficult or impossible when worn by a patient. Such boots are generally very hot, causing an elevation in skin temperature. As discussed previously herein, as skin temperature rises, the cells affected require more oxygen, and a 1° C. rise in skin temperature may raise the metabolic demand at the cellular level by 10%. For example, an increase of 6° (a common amount in a boot) could raise the requirement for oxygen and other life sustaining nutrients by 60%, dramatically increasing the rate of tissue damage and concurrent sore development.

Another type of product commonly used for pressure sore prevention consists basically of an elevated foam support that supports the leg from the knee area down to the ankle and allows the foot and heel to hang off an edge at the end. When using a device that only supports the back of the leg, gravity and the weight of any bed covers tend to pull the entire foot and leg into lateral rotation. (Lateral rotation can be visualized as laying in bed and turning the foot to the side so that the small toe is closer to the top of the mattress.) The foot has some independent range of motion laterally, but pressure on the foot also tends to rotate the leg from the hip joint. Rotating both legs and feet in this fashion is not usually tolerated by patients, so care providers often resort to the addition of pillows and/or pads stacked to the side of the foot to help prevent this movement. However, additional padding can act as further insulators and cause further heat build-up, thereby negating any ventilation benefit from suspending the foot in the air. Pressure on the foot (i.e., from gravity and any bed covers) can also cause the foot to move downward into plantar flexion. (Plantar flexion can be visualized by imagining "pointing your toes", or the posture that a ballerina would assume when dancing "on point".) As most people do not have the ability or range of motion to have their foot in this "on point" posture, having the foot forced into planter flexion is also uncomfortable for most people. As a result, extra padding is often added to alleviate the flexion, thereby further impeding ventilation.

In several embodiments of the present disclosure, a foot positioner is provided that supports the foot from the ankle. For example, the foot positioner can support the foot of a user relative to a support surface (hereinafter "bed surface") of the bed or piece of furniture in which foot positioner is installed. Embodiments of the positioner can provide benefits such as relieving pressure and/or shear forces exerted on portions of the foot such as the heel, providing lateral support to reduce external rotation of the foot and leg, and/or providing support at the bottom of the foot to reduce planter flexion.

Figure 39:
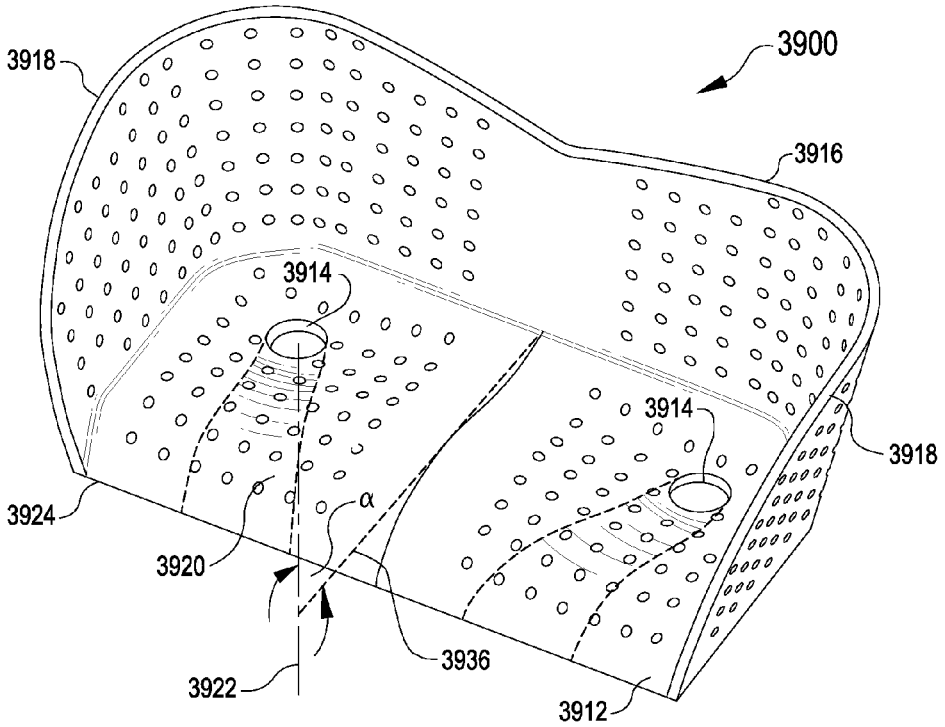
FIG. 39 is a top perspective view of a foot positioner in accordance with various embodiments.

Referring now to the drawings, FIG. 39 shows a top perspective view of a foot positioner 3900 in accordance with various embodiments. The foot positioner 3900 can include a base 3912 with two wells 3914 in which a user's heels can rest. For example, the wells 3914 can be cut-out areas where the heels can fit. In some aspects, the wells 3914 can be tapered, such as to better accommodate heels of varying sizes. The base 3912 may provide ankle and lower leg support with a height or thickness sufficient to suspend heels above the bed surface when placed in the wells 3914. Suspending heels above the bed surface can reduce or eliminate most contact and pressure between the heels and the bed surface, which can consequently reduce the risk of pressure sores at the heel. As may also be appreciated, although descriptions herein refer to two wells 3914, in some aspects, a foot positioner 3900 may be configured for a single foot such that it only includes a single well 3914.

The base 3912 can also include leg troughs 3920. A leg trough 3920 can help position and stabilize a user's leg to improve comfort and keep the associated heel in alignment with the associated well 3914. A leg trough 3920 can include a recessed portion of the base 3912 extending from a front edge 3924 of the base 3912 to a well 3914 or along some subset there between. In some aspects, a boundary of the leg trough 3920 can be formed in part by a raised area 3908 in the middle of the base 3912. In normal anatomical posture in the resting position, a person's heels are positioned wider apart than the hips. In this anatomical posture, the legs are generally positioned at an angle from sagital midline between 5° and 10° (depending on the person). To accommodate for this normal posture, the leg trough 3920 may be formed having an axis 3922 arranged at an angle $\alpha$ from a longitudinal axis 3936 of the foot positioner 3900. The angle $\alpha$ can be selected to correspond to the anticipated resting position of a user. Providing a leg trough 3920 arranged at an angle $\alpha$ may increase comfort of a user of the foot positioner 3900. In some aspects, a strap may also be provided to retain a user's leg in the leg trough 3920. Such a strap may prevent a patient from pulling one leg out of the well 3914, such as may occur if the patient has unwanted movement of the lower leg as a secondary issue relative to their need for heel protection. As may also be appreciated with reference to FIG. 41, in some aspects, leg troughs 3920 can include additional contouring to match the shape of a lower leg. For example, the leg trough 3920 may include a taper from the well 3914 upward to the top surface 3902 of the base 3912. As another example, the leg trough can taper down to a thin edge at the front edge 3924 of the base 3912, corresponding to a contour of a lower calf of a leg.

Figure 40:
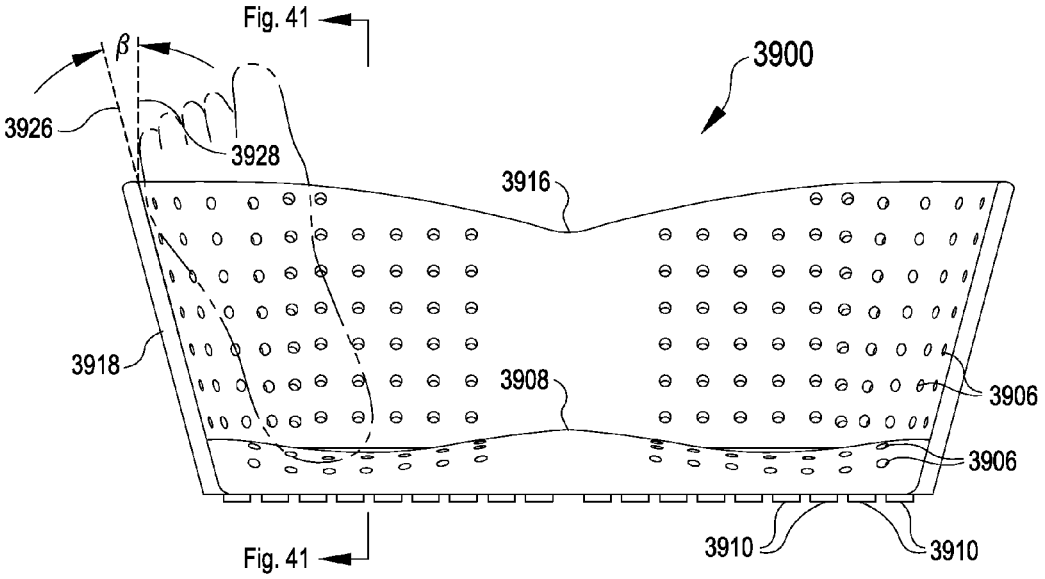
FIG. 40 is a front view of a foot positioner in accordance with various embodiments.

The foot positioner 3900 can also include wall sections that extend upward from the base, such as lateral walls 3918 and rear wall 3916. Such walls may support the feet and reduce the tendency of the feet to be forced into uncomfortable external rotation and plantar flexion. It should be noted that a small degree of external rotation and/or plantar flexion may not be uncomfortable for many patients. In fact, when laying in supine position a person's foot normally assumes a natural rest angle that is both externally rotated and in planter flexion. As may be best seen in FIG. 40, the lateral wall 3918 can be aligned along an axis 3926 that is angled outward away from a vertical direction 3928 at an angle $\beta$ to allow the foot to be supported in this resting posture with regard to lateral rotation. The angle $\beta$ can be selected to correspond to the anticipated resting position of a user. In the embodiment depicted in FIG. 41, the angle $\beta$ is approximately 15°; however, $\beta$ need not be so limited and further experimentation may indicate other angles to be generally preferred by patients. As may be best seen in FIG. 41, the rear wall 3916 can be aligned along an axis 3930 that is angled outward away from a vertical direction 3928 at an angle $\gamma$ to allow the foot to be supported in this resting posture with regard to plantar flexion. The angle $\gamma$ can be selected to correspond to the anticipated resting position of a user. In the embodiment depicted in FIG. 41, the angle $\gamma$ is approximately 15°; however, $\gamma$ need not be so limited and further experimentation may indicate other angles to be generally preferred by patients.

In some aspects, the lateral walls 3918 and/or the rear wall 3916 can support bed covers and maintain a separation between the covers and a user's toes. For example, the height of the lateral walls 3918 and/or the rear wall 3916 may be selected such that a user's toes will not extend beyond the lateral walls 3918 and/or the rear wall 3916. Such a configuration could reduce uncomfortable pressure on a user's feet from the covers.

Figure 41:
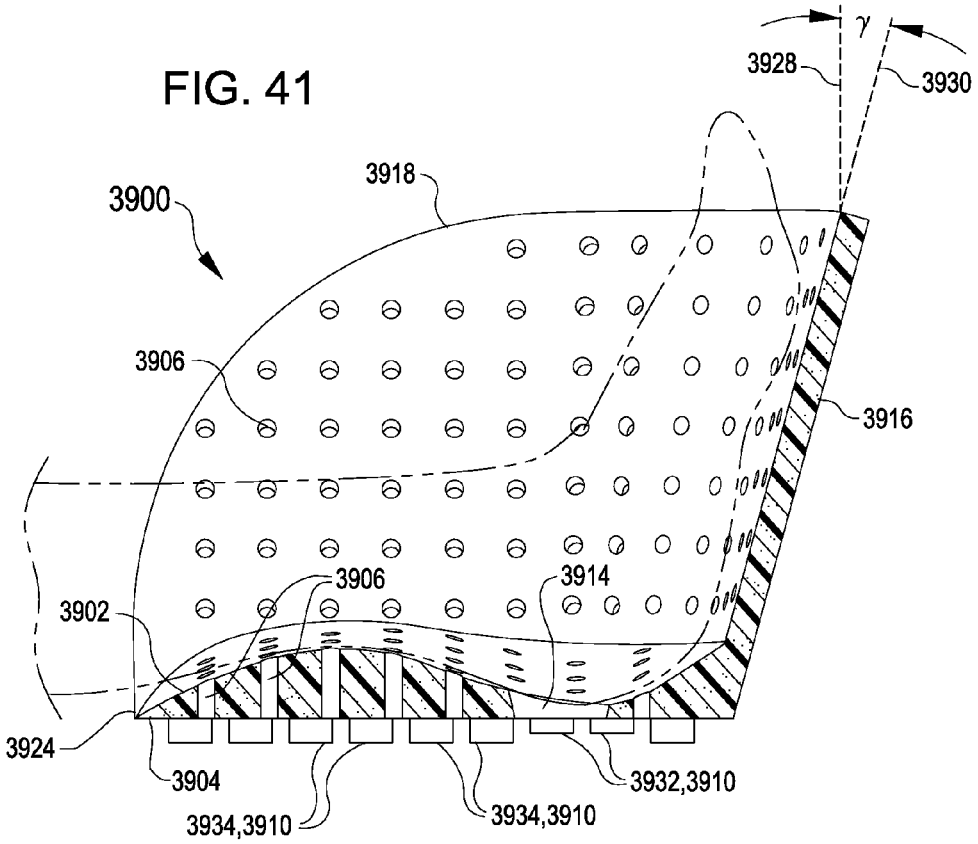
FIG. 41 is a side cross-sectional view of a foot positioner in accordance with various embodiments.

As may be best seen with respect to FIG. 41, the foot positioner 3900 can have a plurality of holes or ports 3906, each of which passes through top surface 3902 of the foot positioner 3900 and through bottom surface 3904. A plurality of supports 3910 can provide the support necessary to offset the bottom surface 3904 of the foot positioner 3900 from the bed surface. The combination of the holes 3906 and the supports 3910 can provide improved airflow to a user's foot or feet. The offset achieved by the supports 3910 (shown in the form of pillars in FIG. 39) can allow air to pass between the bottom surface 3904 of the foot positioner 3900 and the bed surface, unlike boots which preclude such substantial airflow as a result of the direct contact between the boot and the bed surface. Furthermore, the holes 3906 can provide a path by which the air between the bottom surface 3904 of foot positioner 3900 and the bed surface can directly ventilate the user's foot or feet, providing an avenue for heat and moisture to escape. In various aspects, the rear wall 3916 and/or the lateral walls 3918 can also include ports 3906 for improved airflow. In some aspects, at least some of such ports 3906 can be sized to allow the passage of fingers so that the ports 3906 can also serve as handles or gripping surfaces to faciliate adjusting the position of the foot positioner 3900 on the bed surface.

As shown in FIG. 41, in many embodiments, pillars 3910 can be of varying heights. For example, some pillars (e.g. 3932) may vary in height from other pillars (e.g. 3934) in order to allow portions of the foot positioner 3900 to bend in response to load to conform to a user's body as the user places or shifts weight on the foot positioner 3900. This allows the foot positioner 3900 to have a dynamic response in which it bends and flexes according to the user's weight to more evenly (when compared to just immersion or a fixed contour) redistribute pressure applied by the bed surface to the user's feet. As the foot positioner 3900 changes shape in conforming to the load and contour of the individual user, pressure is distributed away from areas of high pressure and to areas of lower pressure, thereby improving comfort and reducing the occurrence of the pressure concentration points that can cause pressure sores associated with prolonged time in a bed or otherwise immobile. In various embodiments, the pattern of pillars 3910 with differing heights is configured to focus the dynamic response in areas known to carry the most load or to exert the most pressure. For example, in various embodiments, the pillars which vary in height are grouped in areas of the foot positioner 3900 where the heels of a user are most likely to contact the foot positioner 3900, such as beneath the wells 3914. Although the wells 3914 are shown as extending all the way through the foot positioner 3900, in some aspects, the wells 3914 may not extend all the way through. For example, the wells 3914 may include a bottom that is supported by pillars 3910 of varying heights to provide a bending and flexing bottom of the well 3914. Additionally, although various contours and tapers of the foot positioner 3900 are depicted as molded into the foot positioner 3910, in some aspects, the molding of the foot positioner 3910 may be supplemented with or substituted by use of pillars 3910 having different size heights.

As may be appreciated from the foregoing description, the foot positioner 3900 can be produced in a variety of different sizes. Various features may be arranged or sized differently to accommodate different users or anticipated users. For example, heights of lateral walls 3918 and/or rear walls 3916, angles $\alpha$ of leg troughs 3920, angles $\beta$ of lateral walls 3918, angles $\gamma$ of rear walls 3916, degrees of taper in wells 3914 and/or leg troughs 3920, heights of pillars 3910, and size of ports 3906 are all variables that may be adjusted as desired.

Additional benefits of the foot positioner 3900 can be appreciated given the possibility that in several contexts (such as in a hospital setting) the foot positioner 3900 may undergo substantial exposure to moisture such as perspiration, urination, or defecation. The holes 3906 in the foot positioner 3900 can allow moisture to pass through the foot positioner 3900, providing additional surface area for convection to work to evaporate the moisture. Additionally, in many embodiments the foot positioner 3900 is made with non-absorbent and completely washable material (for example, EVA foam, such as described above). Use of this material permits the foot positioner 3900 to be easily rinsed free of offending moisture, unlike some boots that tend to absorb the moisture in a material that is difficult to effectively clean. This ease of washing makes the foot positioner 3900 particularly useful in healthcare contexts that utilize plastic covering to protect mattresses. The foot positioner 3900 can be placed on top of a bed mattress having a plastic covering. The foot positioner 3900 can provide additional ventilation to resolve heat dissipation issues of the plastic covering. Additionally, should a patient inadvertently defecate or urinate, the plastic will prevent damage to the mattress from drainage through the holes 3906 in the foot positioner 3900, and the foot positioner 3900 can be washed instead of replaced.

Other benefits include the easy of application of the foot positioner 3900 in comparison to boot-type devices. The foot positioner 3900 can sit on the bed surface and under the top covers. A care provider need not attach and detach the foot positioner 3900, as might otherwise be necessary with a boot. For people that can ambulate, this is a great benefit since the boots commonly used in facilities need to be removed before someone can get up to use toilet facilities. In contrast, with a foot positioner 3900, the person that is able can just pull the covers aside and get out of bed.

In some aspects, embodiments can be provided according to one or more of the following examples.

Example #1

Provided can be an orthotic shoe insert for use in a shoe with a footbed, the orthotic comprising: (i) a body; (ii) a top surface on a top side of the body; (iii) a bottom surface on a bottom side of the body and configured to face the shoe footbed when the orthotic is installed in the shoe, the bottom surface comprising at least one support configured to, when the orthotic is installed in the shoe, offset the bottom surface from the shoe footbed an amount sufficient to allow airflow between the bottom surface and the footbed; and (iv) a plurality of holes, each hole in the plurality passing through the top surface, extending through the body, and passing through the bottom surface.

Example #2

Provided can be a sleeping surface overlay for use with a sleeping surface, the overlay comprising: (i) a body; (ii) a top surface on a top side of the body; (iii) a bottom surface on a bottom side of the body and configured to face the sleeping surface when the overlay is installed on the sleeping surface, the bottom surface comprising at least one support configured to, when the overlay is installed on the sleeping surface, offset the bottom surface from the sleeping surface an amount sufficient to allow airflow between the bottom surface and the sleeping surface; and (iv) a plurality of holes, each hole in the plurality passing through the top surface, extending through the body, and passing through the bottom surface.

Example #3

Provided can be a pet crate liner for use in a pet crate have a crate floor, the liner comprising: (i) a body; (ii) a top surface on a top side of the body; (iii) a bottom surface on a bottom side of the body and configured to face the crate floor when the pet crate liner is installed in the pet crate, the bottom surface comprising at least one support configured to, when the pet crate liner is installed in the pet crate, offset the bottom surface from the crate floor an amount sufficient to allow airflow between the bottom surface and the crate floor; and (iv) a plurality of holes, each hole in the plurality passing through the top surface, extending through the body, and passing through the bottom surface.

Example #4

Provided can be a bicycle seat cover cushion for use on a bicycle seat, the seat cover comprising: (i) a body; (ii) a top surface on a top side of the body; (iii) a bottom surface on a bottom side of the body and configured to face a top face of the bicycle seat when the cover is installed in the seat, the bottom surface comprising at least one support configured to, when the cover is installed on the seat, offset the bottom cover surface from the seat top face an amount sufficient to allow airflow between the bottom cover surface and the seat top face; and (iv) a plurality of holes, each hole in the plurality passing through the cover top surface, extending through the cover body, and passing through the cover bottom surface.

Example #5

Provided can be the seat cover of Example #4, further comprising a casing of breathable material conforming around the body and configurable to secure the seat cover to the seat.

Example #6

Provided can be a yoga mat for use on a ground surface, the yoga mat comprising: (i) a body; (ii) a top surface on a top side of the body; (iii) a bottom surface on a bottom side of the body and configured to face the ground surface when the yoga mat is placed on the ground surface, the bottom surface comprising at least one support configured to, when the yoga mat is placed on the ground surface, offset the bottom surface from the ground surface an amount sufficient to allow airflow between the bottom surface and the ground surface; and (iv) a plurality of holes, each hole in the plurality passing through the top surface, extending through the body, and passing through the bottom surface.

Example #7

Provided can be a helmet comprising: (i) an exterior shell; and (ii) a liner configured to fit inside the shell, the liner comprising a plurality of pillars extending from an inner surface of the liner toward an interior of the helmet, the pillars configured to, when the helmet is worn on a head of a user, offset the inner surface of the liner from the head of the user an amount sufficient to allow airflow there between.

Example #8

Provided can be the helmet of Example #7, the liner further comprising a plurality of holes, each of the holes passing through the liner.

Example #9

Provided can be the helmet of Example #8 (or any of Examples 7-8), the shell further comprising a plurality of holes, each of the holes passing through the shell.

Example #10

Provided can be the helmet of Example #9 (or any of Examples 7-9), wherein the plurality of holes in the shell aligns sufficiently with the plurality of holes in the liner to allow airflow through at least some aligned holes when the helmet is worn on the head of the user.

Example #11

Provided can be a helmet liner configured to fit inside a helmet, the liner comprising: (i) an inner surface shaped to at least partially surround a head of a user when worn by the user; and (ii) a plurality of pillars extending from the inner surface of the liner toward the head of a user when worn by the user, the pillars configured to, when the liner is worn on a head of a user, offset the inner surface of the liner from the head of the user an amount sufficient to allow airflow there between.

Example #12

Provided can be a foot positioner for use with a bed surface, the foot positioner comprising: (i) a base; (ii) a top surface on a top side of the base; (iii) a bottom surface on a bottom side of the base and configured to face the bed surface when the foot positioner is installed on the bed surface, the bottom surface comprising at least one support configured to, when the overlay is installed on the sleeping surface, offset the bottom surface from the bed surface an amount sufficient to allow airflow between the bottom surface and the bed surface; and (iv) a plurality of holes, each hole in the plurality passing through the top surface, extending through the base, and passing through the bottom surface.

Example #13

Provided can be the foot positioner of Example #12, further comprising at least one well configured to receive a heel of a user of the foot positioner and support the heel above the bed surface.

Example #14

Provided can be the foot positioner of Example #12 (or any of Examples 12-13), further comprising a wall extending upward from the base, the wall configured to support a foot so as to reduce an amount of planar extension of the foot.

Example #15

Provided can be the foot positioner of Example #12 (or any of Examples 12-14), further comprising a wall extending upward from the base, the wall configured to support a foot so as to reduce an amount of lateral rotation of the foot.

Example #16

Provided can be the foot positioner of Example #14 (or any of Examples 12-15), wherein the wall is angled relative to vertical.

Example #17

Provided can be the foot positioner of Example #15 (or any of Examples 12-16), wherein the wall is angled relative to vertical.

Example #18

Provided can be the foot positioner of Example #14 (or any of Examples 12-17), wherein the wall comprises a second plurality of holes extending therethrough.

Example #19

Provided can be the foot positioner of Example #15 (or any of Examples 12-18), wherein the wall comprises a second plurality of holes extending therethrough.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A seat cushion comprising:

a body;

a top surface on a top side of the body;

a bottom surface on a bottom side of the body and configured to face a support surface, the bottom surface comprising at least one support configured to offset the bottom surface from the support surface an amount sufficient to allow airflow between the bottom surface and the support surface;

a plurality of holes, each hole in the plurality passing through the top surface, extending through the body, and passing through the bottom surface; and a plurality of troughs disposed on the bottom surface and embedded into the body, the plurality of troughs disposed between the at least one support to decrease surface tension on the bottom surface near the plurality of troughs.

2. The seat cushion of claim 1 wherein the at least one support further comprises:

a first subset of the at least one support dimensioned to contact the support surface when the seat cushion is in an unloaded configuration;

a second subset of the at least one support dimensioned to not contact the support surface in the unloaded configuration;

wherein in a loaded configuration when a weight of a user is placed on the top surface at least some of the supports in the second subset of supports contact the support surface; and wherein a number of the supports in the second subset of supports that contact the support surface in the loaded configuration depends on a specific weight and body contour of the user.

3. The seat cushion of claim 2, wherein the supports corresponding to the second subset are shortest underneath an area of the seat cushion for receiving ischial tuberosities of the user and increase in height as support placement on the bottom surface moves away from the area of the seat cushion for receiving ischial tuberosities of the user.

4. The cushion of claim 2, wherein the seat cushion deforms primarily by bending as a load is applied in the loaded configuration.

5. The cushion of claim 2, wherein the top surface further comprises a contour configured to match a generic anatomical shape of a seated user.

6. The cushion of claim 5, wherein the contour further comprises a recessed area configured to receive a pelvis and coccyx of the seated user and elevated components to support and orient thighs and hips of the seated user.

7. The seat cushion of claim 1 wherein the at least one support further comprises:

a first subset of the at least one support dimensioned to contact the support surface when the cushion is in an unloaded configuration;

a second subset of the at least one support dimensioned to not contact the support surface in the unloaded configuration, the second subset of the at least one support having an unloaded height being a sum of the distance between a bottom of each support of the second subset and the support surface in the unloaded configuration;

wherein in a loaded configuration when a weight of a user is placed on the top surface the unloaded height is greater than a loaded height being a sum of the distance between a bottom of each support of the second subset and the support surface in the loaded configuration;

wherein a difference between the unloaded height and the loaded height depends on a specific weight and body contour of the user.

8. The seat cushion of claim 7, wherein the supports corresponding to the second subset are shortest underneath an area of the seat cushion for receiving ischial tuberosities of the user and increase in height as support placement on the body moves away from an area of the seat cushion for receiving ischial tuberosities of the user.

9. The seat cushion of claim 7, wherein the cushion deforms primarily by bending as a load is applied in the loaded configuration.

10. The seat cushion of claim 7, wherein the body further comprises a contour configured to match a generic anatomical shape of a seated user.

11. The seat cushion of claim 10, wherein the contour further comprises a recessed area configured to receive a pelvis and coccyx of the seated user and elevated components to support and orient thighs and hips of the seated user.

12. The seat cushion of claim 1, wherein the troughs are rounded.

13. The cushion of claim 1, wherein the troughs are positioned in a row and column pattern.

14. The cushion of claim 1, wherein the troughs are positioned only in locations of maximum surface tension.

15. The cushion of claim 1, wherein the troughs extend over the entirety of the bottom surface.

16. The cushion of claim 1, wherein the embedded plurality of troughs form a plurality of depressions in the body.

17. The cushion of claim 1, wherein the embedded plurality of troughs form a plurality of channels in the body.

18. The cushion of claim 1, wherein the embedded plurality of troughs form a plurality of indentations in the body.

19. The cushion of claim 1, wherein the embedded plurality of troughs connect at least two holes of the plurality of holes.

* * * * *